US011035134B2

(12) United States Patent
Evans et al.

(10) Patent No.: US 11,035,134 B2
(45) Date of Patent: Jun. 15, 2021

(54) SYSTEMS FOR AND METHODS OF CONDITIONING LOOSEFILL INSULATION MATERIAL

(71) Applicant: Owens Corning Intellectual Capital, LLC, Toledo, OH (US)

(72) Inventors: James Justin Evans, Granville, OH (US); Michael Eugene Evans, Granville, OH (US); Timothy H. Newell, Nephi, UT (US); Apollo Hannon, Mt. Pleasant, UT (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 312 days.

(21) Appl. No.: 16/171,447

(22) Filed: Oct. 26, 2018

(65) Prior Publication Data

US 2019/0127993 A1 May 2, 2019

Related U.S. Application Data

(60) Provisional application No. 62/577,765, filed on Oct. 27, 2017.

(51) Int. Cl.

| | |
|---|---|
| ***E04F 21/08*** | (2006.01) |
| ***B02C 18/22*** | (2006.01) |
| ***B02C 21/02*** | (2006.01) |
| ***B02C 23/20*** | (2006.01) |
| ***B02C 23/40*** | (2006.01) |

(52) U.S. Cl.

CPC ..... *E04F 21/085* (2013.01); *B02C 18/2216* (2013.01); *B02C 21/02* (2013.01); *B02C 23/20* (2013.01); *B02C 23/40* (2013.01)

(58) Field of Classification Search

CPC .... E04F 21/085; B02C 18/2216; B02C 21/02; B02C 23/20; B02C 23/40

USPC ..... 241/60

See application file for complete search history.

(56) References Cited

U.S. PATENT DOCUMENTS

| | | | | |
|---|---|---|---|---|
| 2,754,155 | A * | 7/1956 | Kempthorne et al. | B65G 53/526 406/12 |
| 3,085,834 | A * | 4/1963 | Woten | E04F 21/12 406/53 |
| 4,213,490 | A | 7/1980 | Knock | |
| 4,272,935 | A | 6/1981 | Lukas et al. | |
| 4,530,468 | A * | 7/1985 | Sperber | B05B 7/0025 239/419.3 |
| 4,644,014 | A * | 2/1987 | Thomson | B29B 7/7438 521/68 |
| 5,795,517 | A | 8/1998 | Heisler et al. | |
| 5,829,649 | A | 11/1998 | Horton | |
| 6,012,263 | A * | 1/2000 | Church | B05B 7/1409 156/71 |
| 6,029,897 | A | 2/2000 | Jander | |
| 6,206,050 | B1 | 3/2001 | Kelley et al. | |
| 6,336,474 | B1 | 1/2002 | Kelley et al. | |
| 6,401,757 | B1 | 6/2002 | Pentz et al. | |
| 6,503,026 | B1 | 1/2003 | Mitchell | |

(Continued)

*Primary Examiner* — Shelley M Self
*Assistant Examiner* — Smith Oberto Bapthelus
(74) *Attorney, Agent, or Firm* — Calfee, Halter & Griswold LLP

(57) ABSTRACT

A machine for distributing unbonded loosefill insulation material through a hose connected thereto is disclosed. The machine includes a fluidizer having one or more air knives for conditioning the loosefill material as it is being applied.

26 Claims, 16 Drawing Sheets

(56) References Cited

U.S. PATENT DOCUMENTS 6,648,022 B2 11/2003 Pentz et al.
6,684,907 B2 2/2004 Yang et al.
6,719,864 B2 4/2004 Kelley et al.
6,732,960 B2 5/2004 Shaw et al.
D531,284 S 10/2006 Wagner et al.
D531,706 S 11/2006 Wagner et al.
D531,707 S 11/2006 Wagner et al.
D531,708 S 11/2006 Wagner et al.
7,284,573 B2 10/2007 Wagner et al.
7,341,631 B2 * 3/2008 Fellinger ..... B05B 7/1422 118/308
7,357,888 B2 * 4/2008 Michael ..... B29C 70/305 239/8
7,475,830 B2 1/2009 Fellinger
7,520,459 B2 4/2009 O'Leary
7,594,618 B2 * 9/2009 Fellinger ..... E04B 1/7604 241/189.1
7,712,690 B2 5/2010 Johnson et al.
7,731,115 B2 6/2010 Johnson et al.
7,735,755 B2 * 6/2010 Near ..... B05B 7/1495 239/425
7,789,596 B2 * 9/2010 Fellinger ..... E04F 21/085 406/46
7,819,349 B2 10/2010 Johnson et al.
7,887,662 B2 2/2011 Wagner et al.
7,938,348 B2 5/2011 Evans et al.
7,971,813 B2 * 7/2011 O'Leary ..... E04F 21/085 241/60
8,794,554 B2 8/2014 Evans
2006/0024458 A1 * 2/2006 O'Leary ..... B02C 18/2216 428/35.2
2006/0162649 A1 * 7/2006 Fellinger ..... E04F 21/085 118/300
2008/0217422 A1 * 9/2008 Near ..... E04F 21/085 239/8
2008/0245885 A1 * 10/2008 Near ..... B05B 7/1495 222/567
2011/0198426 A1 * 8/2011 Piotrowski ..... B01F 7/00258 241/101.71
2015/0143774 A1 * 5/2015 Downey ..... D04H 1/02 52/741.4

* cited by examiner

LINE A-A

LINE B-B

SYSTEMS FOR AND METHODS OF CONDITIONING LOOSEFILL INSULATION MATERIAL

CROSS REFERENCE TO RELATED APPLICATIONS

This application claims priority to and any benefit of U.S. Provisional Patent Application No. 62/577,765, filed Oct. 27, 2017, the content of which is incorporated herein by reference in its entirety.

FIELD

The general inventive concepts generally relate to loosefill insulation for insulating buildings and, more specifically, to the conditioning of loosefill insulation during application thereof.

BACKGROUND

Machines for distributing loosefill insulation are well known. For example, one such machine is disclosed in U.S. Pat. No. 8,794,554, the entire disclosure of which is incorporated herein by reference.

As noted in the '554 patent, a frequently used insulation product is unbonded loosefill insulation. In contrast to the unitary or monolithic structure of insulation batts or blankets, unbonded loosefill insulation is a multiplicity of discrete, individual tufts, cubes, flakes, or nodules. Unbonded loosefill insulation is usually applied to buildings by blowing the unbonded loosefill insulation into an insulation cavity, such as a wall cavity or an attic of a building. Typically, unbonded loosefill insulation is made of glass fibers although other mineral fibers, organic fibers, and cellulose fibers can be used.

Unbonded loosefill insulation, also referred to as blowing wool, is typically compressed and encapsulated in a bag. The compressed unbonded loosefill insulation and the bag form a package. Packages of compressed unbonded loosefill insulation are used for transport from an insulation manufacturing site to a building that is to be insulated. The bags can be made of polypropylene or other suitable materials. During the packaging of the unbonded loosefill insulation, it is placed under compression for storage and transportation efficiencies. The compressed unbonded loosefill insulation can be packaged with a compression ratio of at least about 10:1. The distribution of unbonded loosefill insulation into an insulation cavity typically uses a loosefill blowing machine that feeds the unbonded loosefill insulation pneumatically through a distribution hose. Loosefill blowing machines can have a chute or hopper for containing and feeding the compressed unbonded loosefill insulation after the package is opened and the compressed unbonded loosefill insulation is allowed to expand.

A problem with the delivery of loosefill insulation is described in, for example, U.S. Pat. No. 6,336,474, the entire disclosure of which is incorporated herein by reference.

According to the '474 patent, loosefill insulation is packaged in bags in which the material becomes compacted during storage and shipment. When removed from the bags, the insulation separates into clumps. In order to effectively install the insulation material, it must first be "fluffed up" or conditioned to reduce its density. Traditionally, pneumatic devices are used to both install the insulation and perform the conditioning. The conditioning process breaks up the clumps and then "fluffs" or "opens up" the insulation. The conditioned insulation is then applied pneumatically to an area by blowing it through a hose connected to the pneumatic device. The insulation may be moistened and/or treated with an adhesive in the pneumatic device before installation.

Often, the conditioning which occurs within the insulation dispensing apparatus is not enough to fully "open up" the insulation. If the insulation is not sufficiently conditioned when it leaves the dispensing apparatus, it may be applied unevenly (i.e., in clumps), and it may not have the manufacturer's specified density for the installed thermal resistance desired. Conversely, insulation which is well conditioned allows adhesive and moisture to penetrate the insulation fibers and applies to surfaces more evenly.

Conventional attempts to better condition loosefill insulation during application thereof have generally included modifications to the delivery hose.

For example, the '474 patent discloses helical projections 140 that extend into an inner region of a hose 100 for delivering loosefill insulation. The loosefill insulation flowing through the hose 100 collides with the different portions of the helical projections 140 and is further "opened up" or conditioned.

See also U.S. Pat. Nos. 6,401,757; 6,648,022; and 7,887,662, the entire disclosure of each being incorporated herein by reference, for other examples of modified hoses or related devices for conditioning loosefill insulation prior to application thereof.

Notwithstanding these conventional approaches, there remains a need for an improved device for increasing the conditioning of loosefill insulation.

SUMMARY

The above objects as well as other objects not specifically enumerated are achieved by the use of one or more "air knives" for further conditioning loosefill insulation during application thereof.

In one exemplary embodiment, a system for conditioning loosefill material during application thereof is provided. The system comprises a machine for distributing loosefill material, the machine including: a chute configured to receive and direct the loosefill material in a machine direction; a shredder configured to shred and pick apart the loosefill material; and a blower for distributing the loosefill material into an airstream. The system also comprises a hose connected to the machine for conveying the loosefill material in the airstream; and a fluidizer for receiving the loosefill material in the airstream and conditioning the loosefill material to decrease its average density. The fluidizer includes an air knife for generating a shaped stream of air that impinges on the loosefill material within the fluidizer.

In some exemplary embodiments, the fluidizer is positioned between the machine and the hose.

In some exemplary embodiments, the hose includes an input end and an output end; the loosefill material enters the hose at the input end; the loosefill material exits the hose at the output end; and the fluidizer is positioned at the output end of the hose.

In some exemplary embodiments, the hose includes an input end and an output end; the loosefill material enters the hose at the input end; the loosefill material exits the hose at the output end; a first fluidizer is positioned at the input end of the hose; and a second fluidizer is positioned at the output end of the hose.

In some exemplary embodiments, the hose includes an input end and an output end; the loosefill material enters the hose at the input end; the loosefill material exits the hose at the output end; and the fluidizer is positioned closer to the output end of the hose than the input end of the hose.

In some exemplary embodiments, the hose includes an input end and an output end; the loosefill material enters the hose at the input end; the loosefill material exits the hose at the output end; and the fluidizer is positioned closer to the input end of the hose than the output end of the hose.

In some exemplary embodiments, the hose includes an input end and an output end; the loosefill material enters the hose at the input end; the loosefill material exits the hose at the output end; and the fluidizer is positioned so as to at least partially overlap with the portion of the hose equidistant from the input end of the hose and the output end of the hose.

In some exemplary embodiments, the hose includes a plurality of discrete segments; and the fluidizer is positioned between two adjacent segments.

In some exemplary embodiments, an inner surface of the hose is smooth. In some exemplary embodiments, an inner surface of the hose is not smooth (e.g., is corrugated).

In some exemplary embodiments, the air knife operates at a pressure within the range of 1 psi to 5 psi. In some exemplary embodiments, the air knife operates at a pressure of 2.5 psi.

In some exemplary embodiments, the air knife operates at a pressure within the range of 40 psi to 120 psi. In some exemplary embodiments, the air knife operates at a pressure of 80 psi.

In some exemplary embodiments, the fluidizer includes a plurality of air knives.

In some exemplary embodiments, the fluidizer includes a first air knife that generates a first shaped stream of air; the fluidizer includes a second air knife that generates a second shaped stream of air; and the first shaped stream of air and the second shaped stream of air flow parallel to one another within the fluidizer.

In some exemplary embodiments, the fluidizer includes a first air knife that generates a first shaped stream of air; the fluidizer includes a second air knife that generates a second shaped stream of air; and the first shaped stream of air and the second shaped stream of air intersect with one another within the fluidizer.

In one exemplary embodiment, a method of conditioning loosefill material during application thereof is provided. The method comprises: feeding compressed loosefill material into a machine for distributing the loosefill material; shredding and picking apart the loosefill material within the machine; distributing the loosefill material into an airstream; conveying the airstream with the loosefill material through a hose; and prior to the application of the loosefill material, passing the airstream with the loosefill material through a fluidizer such that a shaped stream of air from an air knife impinges on the loosefill material in the airstream.

In some exemplary embodiments, the compressed loosefill material has a compression ratio of at least 5:1.

In one exemplary embodiment, a system for conditioning loosefill material during application thereof is provided. The system comprises a machine for distributing loosefill material, the machine including a chute configured to receive and direct the loosefill material into the machine; one or more shredders configured to condition the loosefill material to a first density; and a discharge mechanism configured to direct the loosefill material having the first density out of the machine. The system also comprises a hose configured to convey the loosefill material from the machine to an installation location; and a fluidizer comprising one or more air knives, the fluidizer configured to condition the loosefill material to a second density, wherein the second density is less than the first density. In some exemplary embodiments, the hose conditions the loosefill material to an intermediate density that is between the first density and the second density.

Various objects and advantages of this invention will become apparent to those skilled in the art from the following detailed description of the preferred embodiment, when read in light of the accompanying drawings.

BRIEF DESCRIPTION OF THE DRAWINGS

FIG. 4A illustrates the arrangement of a hose and a loosefill blowing machine. FIG. 4B illustrates an air knife positioned along the hose of FIG. 4A. FIG. 4C illustrates an air knife positioned along the hose of FIG. 4A. FIG. 4D illustrates an air knife positioned along the hose of FIG. 4A. FIG. 4E illustrates a pair of air knives positioned along the hose of FIG. 4A.

FIG. 5A is a side view of the fluidizer device. FIG. 5B is a cross sectional view of the fluidizer device of FIG. 5A, taken along line A-A.

FIG. 6A is a perspective view of the fluidizer device. FIG. 6B is a cross sectional view of the fluidizer device of FIG. 6A, taken along line B-B. FIG. 6C is a cross sectional view of an alternative configuration of the fluidizer device of FIG. 6B. FIG. 6D is a cross sectional view of an alternative configuration of the fluidizer device of FIG. 6B. FIG. 6E is a cross sectional view of an alternative configuration of the fluidizer device of FIG. 6B.

DETAILED DESCRIPTION

The general inventive concepts encompass the use of air knives for further conditioning loosefill insulation during application thereof. An "air knife" is a stream of pressurized air (or other gas) that is directed so as to impinge upon a material and alter its profile (e.g., shape, size). Various exemplary embodiments of air knives are described below, both alone in and in the context of an exemplary loosefill blowing machine.

In accordance with embodiments of the present invention, the description and figures disclose unbonded loosefill insulation systems. The unbonded loosefill insulation systems include a loosefill blowing machine and an associated unbonded loosefill insulation material. Generally, the operating parameters of the loosefill blowing machine are tuned to the insulative characteristics of the associated unbonded loosefill insulation material such that the resulting blown unbonded loosefill insulation material provides improved insulative values. The term "loosefill blowing machine," as used herein, is defined to mean any structure, device or mechanism configured to condition and deliver insulation material into an airstream. The term "loosefill insulation material," as used herein, is defined to any conditioned insulation materials configured for distribution in an airstream. The term "unbonded," as used herein, is defined to mean the absence of a binder. The term "finely conditioned," as used herein, is defined to mean the shredding of unbonded loosefill insulation material to a desired density prior to distribution into an airstream.

Figure 1:
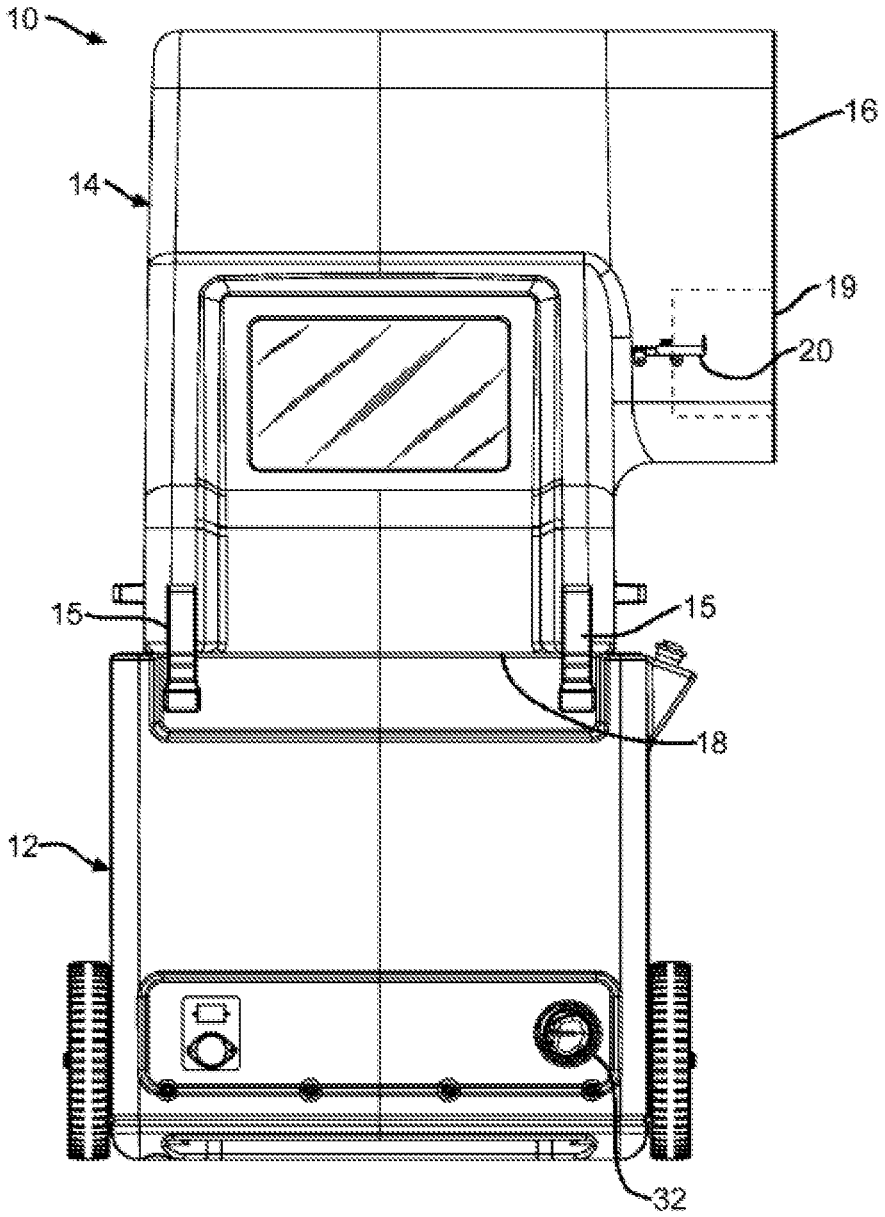
FIG. 1 is a front view in elevation of a loosefill blowing machine, according to an exemplary embodiment.
Figure 2:
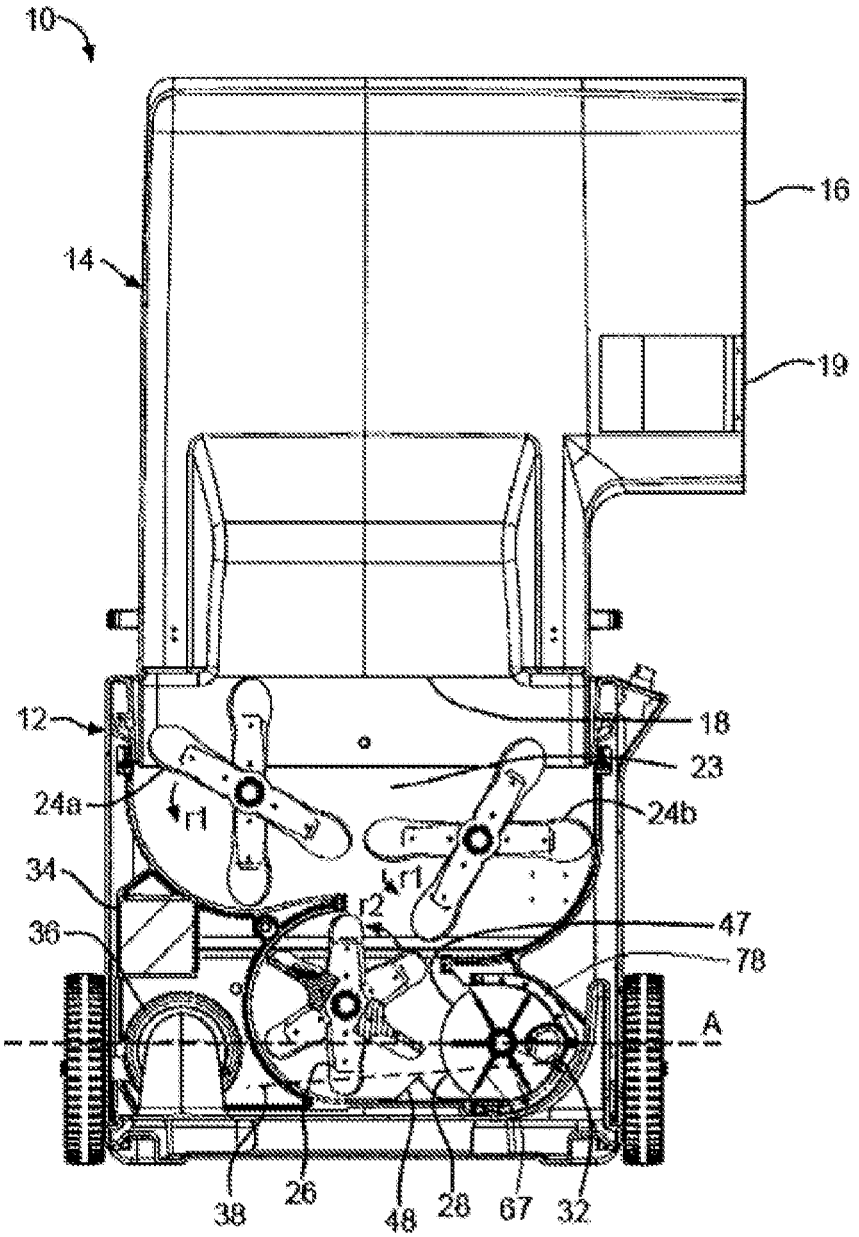
FIG. 2 is a front view in elevation, partially in cross-section, of the loosefill blowing machine of FIG. 1.
Figure 3:
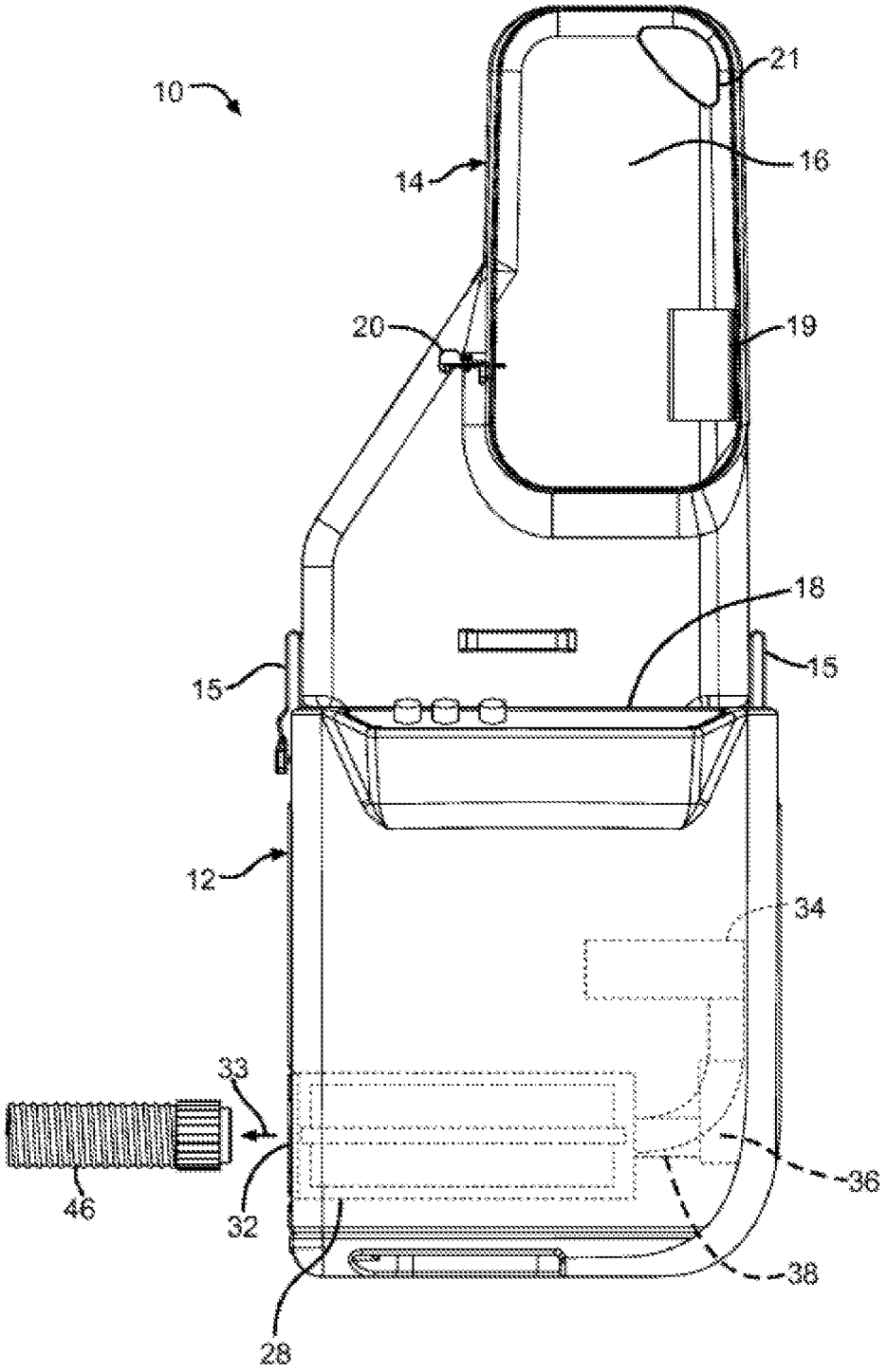
FIG. 3 is a side view in elevation of the loosefill blowing machine of FIG. 1.

One example of a loosefill blowing machine, configured for distributing compressed unbonded loosefill insulation material (hereafter "loosefill material"), is shown at 10 in FIGS. 1-3. The loosefill blowing machine 10 includes a lower unit 12 and a chute 14. The lower unit 12 can be connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive loosefill material and introduce the loosefill material to a shredding chamber 23 as shown in FIG. 2. Optionally, the chute 14 can include a handle segment 21, as shown in FIG. 3, to facilitate easy movement of the loosefill blowing machine 10 from one location to another. However, the handle segment 21 is not necessary to the operation of the loosefill blowing machine 10.

As further shown in FIGS. 1-3, the chute 14 can include an optional guide assembly 19 mounted at the inlet end 16 of the chute 14. The guide assembly 19 is configured to urge a package of loosefill material against an optional cutting mechanism 20, as shown in FIGS. 1 and 3, as the package moves into the chute 14.

As shown in FIG. 2, the shredding chamber 23 is mounted at the outlet end 18 of the chute 14. In the illustrated embodiment, the shredding chamber 23 includes a plurality of low speed shredders 24*a* and 24*b* and an agitator 26. The low speed shredders 24*a* and 24*b* are configured to shred and pick apart the loosefill material as the loosefill material is discharged from the outlet end 18 of the chute 14 into the lower unit 12. Although the loosefill blowing machine 10 is shown with a plurality of low speed shredders 24*a* and 24*b*, any type of separator, such as a clump breaker, beater bar, or any other mechanism that shreds and picks apart the loosefill material can be used.

Referring again to FIG. 2, the agitator 26 is configured to finely condition the loosefill material for distribution into an airstream. In the illustrated embodiment, the agitator 26 is positioned beneath the low speed shredders 24*a* and 24*b*. In other embodiments, the agitator 26 can be positioned in any desired location relative to the low speed shredders 24*a* and 24*b* sufficient to receive the loosefill material from the low speed shredders 24*a* and 24*b* including the non-limiting example of horizontally adjacent to the shredders 24*a* and 24*b*. In the illustrated embodiment, the agitator 26 is a high speed shredder. Alternatively, any type of shredder can be used, such as a low speed shredder, clump breaker, beater bar, or any other mechanism configured to finely condition the loosefill material and prepare the loosefill material for distribution into an airstream.

In the embodiment illustrated in FIG. 2, the low speed shredders 24*a* and 24*b* rotate at a lower speed than the agitator 26. The low speed shredders 24*a* and 24*b* rotate at a speed of about 40-80 rpm and the agitator 26 rotates at a speed of about 300-500 rpm. In other embodiments, the low speed shredders 24*a* and 24*b* can rotate at a speed less than or more than 40-80 rpm, provided the speed is sufficient to shred and pick apart the loosefill material. The agitator 26 can rotate at a speed less than or more than 300-500 rpm provided the speed is sufficient to finely condition the loosefill material and prepare the loosefill material for distribution into an airstream.

Referring again to FIG. 2, a discharge mechanism 28 is positioned adjacent to the agitator 26 and is configured to distribute the finely conditioned loosefill material in an airstream. In this embodiment, the finely conditioned loosefill material is driven through the discharge mechanism 28 and through a machine outlet 32 by an airstream provided by a blower 36 mounted in the lower unit 12. The airstream is indicated by an arrow 33 as shown in FIG. 3. In other embodiments, the airstream 33 can be provided by other methods, such as by a vacuum, sufficient to provide an airstream 33 driven through the discharge mechanism 28. In the illustrated embodiment, the blower 36 provides the airstream 33 to the discharge mechanism 28 through a duct 38, shown in phantom in FIG. 2 from the blower 36 to the discharge mechanism 28. Alternatively, the airstream 33 can be provided to the discharge mechanism 28 by other structures, devices, or mechanisms, including the non-limiting examples of a hose or pipe, sufficient to provide the discharge mechanism 28 with the airstream 33.

The shredders 24*a* and 24*b*, agitator 26, discharge mechanism 28, and the blower 36 are mounted for rotation and driven by a motor 34. The mechanisms and systems for driving the shredders 24*a* and 24*b*, agitator 26, discharge mechanism 28, and the blower 36 will discussed in more detail below.

In operation, the chute 14 guides the loosefill material to the shredding chamber 23. The shredding chamber 23 includes the low speed shredders 24*a* and 24*b* configured to shred and pick apart the loosefill material. The shredded loosefill material drops from the low speed shredders 24*a* and 24*b* into the agitator 26. The agitator 26 finely conditions the loosefill material for distribution into the airstream 33 by further shredding the loosefill material. The finely conditioned loosefill material exits the agitator 26 and enters the discharge mechanism 28 for distribution into the airstream 33 caused by the blower 36. The airstream 33, with the finely conditioned loosefill material, exits the machine 10 at a machine outlet 32 and flows through a distribution hose 46, as shown in FIG. 3, toward the insulation cavity, not shown.

Referring again to FIG. 2, the discharge mechanism 28 is configured to distribute the finely conditioned loosefill material into the airstream 33. In the illustrated embodiment, the discharge mechanism 28 is a rotary valve. Alternatively, the discharge mechanism 28 can be other mechanisms including staging hoppers, metering devices, or rotary feeders, sufficient to distribute the finely conditioned loosefill material into the airstream 33.

Referring again to FIG. 2, the low speed shredders 24*a* and 24*b* rotate in a counter-clockwise direction r1 (as shown in FIG. 2) and the agitator 26 rotates in a counter-clockwise direction r2 (also shown in FIG. 2). Rotating the low speed shredders 24*a* and 24*b* and the agitator 26 in the same counter-clockwise direction allows the low speed shredders 24*a* and 24*b* and the agitator 26 to shred and pick apart the loosefill material while substantially preventing an accumulation of unshredded or partially shredded loosefill material in the shredding chamber 23. In other embodiments, the low speed shredders 24*a* and 24*b* and the agitator 26 each could rotate in a clock-wise direction or the low speed shredders 24*a* and 24*b* and the agitator 26 could rotate in different directions provided the relative rotational directions allow finely conditioned loosefill material to be fed into the discharge mechanism 28 while preventing a substantial accumulation of unshredded or partially shredded loosefill material in the shredding chamber 23.

Referring again to FIG. 2, the discharge mechanism 28 has a housing 78 and a plurality of sealing vane assemblies 67 configured to seal against the housing 78. As shown in FIG. 2, the housing 78 encircles a portion of the discharge mechanism 28, the remaining portion of the discharge mechanism forms a side inlet 47. The side inlet 47 is configured to open in a substantially horizontal direction toward the agitator 26 and receive the finely conditioned loosefill material as it is fed from the agitator 26. In the illustrated embodiment, the agitator 26 is positioned to be adjacent to the side inlet 47 of the discharge mechanism 28. In other embodiments, a low speed shredder 24, or a plurality of shredders 24 or agitators 26, or other shredding mechanisms can be adjacent to the side inlet 47 of the discharge mechanism or in other suitable positions.

As shown in FIG. 2, an optional choke 48 can be positioned between the agitator 26 and the discharge mechanism 28. The choke 48 is configured to redirect heavier clumps of loosefill material past the side inlet 47 of the discharge mechanism 28 and back to the low speed shredders 24*a* and 24*b* for further conditioning. The cross-sectional shape and height of the choke 47 can be configured to control the conditioning properties of the loosefill material entering the side inlet 47 of the discharge mechanism 28. While the illustrated embodiment of the choke 48 is shown as having a triangular cross-sectional shape, it should be appreciated that the choke 48 can have any cross-sectional shape and height sufficient to achieve the desired conditioning properties of the loosefill material entering the side inlet 47 of the discharge mechanism 28.

Referring again to FIG. 2, the lower unit 12 includes the blower 36, the duct 38 extending from the blower 36 to the discharge mechanism 28, the motor 34, the low speed shredders 24*a* and 24*b*, and the agitator 26. The lower unit 12 also includes a first drive system (not shown) and a second drive system (not shown). Generally, the first drive system is configured to drive the agitator 26 and also configured to drive the second drive system. The second drive system is configured to drive the low speed shredders 24*a* and 24*b* and the discharge mechanism 28.

The first drive system includes a plurality of drive sprockets, idler sprockets, tension mechanisms, and a drive chain (for purposes of clarity, none of these components are shown). The first drive system components are rotated by the motor 34, which, in turn, causes rotation of the agitator.

Referring again to FIG. 2, the second drive system includes a plurality of drive sprockets, idler sprockets, tension mechanisms, and a drive chain (also for purposes of clarity, none of these components are shown). The second drive system components are rotated by the first drive system, which, in turn, causes rotation of the first low speed shredder 24*a*, the second low speed shredder 24*b*, and the discharge mechanism 28.

In the embodiment illustrated in FIG. 2, the first and second drive systems are configured such that the motor 34 drives each of the shredders 24*a* and 24*b*, the agitator 26, and the discharge mechanism 28. In other embodiments, each of the shredders 24*a* and 24*b*, the agitator 26, and the discharge mechanism 28 can be provided with its own motor.

In the illustrated embodiment, the motor 34 driving the first and second drive systems is configured to operate on a single 15 ampere, 110 volt a.c. power supply. In other embodiments, other power supplies can be used.

Referring again to FIG. 2 and as discussed above, the blower 36 provides the airstream to the discharge mechanism 28 through the duct 38 connecting the blower 36 to the discharge mechanism 28. In the illustrated embodiment, the blower 36 is a commercially available component, such as the non-limiting example of model 119419-00 manufactured by Ametek, Inc., headquartered in Paoli, Pa., although other blowers can be used.

Referring again to FIG. 2, the motor 34, configured to drive the first and second drive systems is controlled by a first controller (not shown). The first controller is configured to control the rotational speed of the motor 34 at a fixed rotational speed such that the resulting rotational speed of the low speed shredders 24*a* and 24*b*, the agitator 26, and the discharge mechanism 28 are also fixed. The first controller can be any structure, device, or mechanism sufficient to control the rotational speed of the motor 34 at a fixed rotational speed. As a result of the fixed rotational speed of the low speed shredders 24*a* and 24*b*, the agitator 26, and the discharge mechanism 28, the flow rate of the finely conditioned loosefill material through the loosefill blowing machine 10 is also at a fixed level.

Referring again to FIG. 2, the blower 36, configured to provide the airstream 33 to the discharge mechanism 28 through a duct 38, is controlled by a second controller (not shown). The second controller is configured to control the operation of the blower 36 such that the resulting flow rate of the airstream from the blower 36 to the discharge mechanism 28 is fixed at a desired flow rate level. The second controller can be any structure, device, or mechanism sufficient to control the rotational speed of the blower 36 at a fixed rotational speed. As a result of the fixed rotational speed of the blower 36, the flow rate of the airstream 33 through the loosefill blowing machine 10 is also at a fixed level.

While the embodiment of the loosefill blowing machine 10 has been described above as having various components operating at certain fixed rotational speeds, it should be appreciated that in other embodiments, the fixed rotational speeds can be at other rotational levels.

Notwithstanding the above-described exemplary embodiments, the general inventive concepts encompass other types and configurations of loosefill blowing machines. By way of example, the general inventive concepts could be applied to the loosefill blowing machines described in U.S. Pat. Nos. 7,971,813; 7,520,459; 7,712,690; 7,731,115; 7,819,349; and 7,938,348, the entire disclosure of each being incorporated herein in its entirety by reference.

With operation of one exemplary loosefill blowing machine 10 having been described, attention will now be turned to the improved means for conditioning the loosefill material outside of the machine or otherwise as it is being applied.

In particular, a system 400 for distributing compressed unbonded loosefill insulation material, according to one exemplary embodiment, is shown in FIGS. 4A-4E. The system 400 includes a loosefill blowing machine 402 (e.g., the loosefill blowing machine 10) that includes an outlet 404 (e.g., the outlet 32). After being processed within the machine 402, loosefill material 420 exits the machine 402 through the outlet 404. A hose 406 conveys the loosefill material to a desired location (e.g., an attic) where it is deposited. In some exemplary embodiments, the hose 406 may comprise multiple segments that are joined to (or otherwise interfaced with) each other and/or other related structure.

The hose 406 includes an input end 408 and an output end 410, with a midline 412 of the hose 406 being equidistant from the ends 408, 410. The input end 408 of the hose 406 is connected to the outlet 404 of the machine 402. The loosefill material 420 exists the hose 406 at the output end 410 such that it is generally traveling in a direction in which the output end 410 is pointing, as indicated by arrow 414.

The hose 406 is typically flexible to facilitate routing of the hose 406 to the desired location and manipulation of the hose 406 during delivery of the loosefill material 420. The hose 406 can be of any suitable length. In some exemplary embodiments, the hose 406 has a length between 100 feet and 300 feet. In some exemplary embodiments, the hose 406 has a length between 125 feet and 175 feet. In some exemplary embodiments, the hose 406 has a length of 150 feet. In some exemplary embodiments, the hose 406 has a length between 225 feet and 275 feet. In some exemplary embodiments, the hose 406 has a length of 250 feet. The hose 406 can be of any suitable diameter. In some exemplary embodiments, the hose 406 has a diameter between 2 inches and 6 inches. In some exemplary embodiments, the hose 406 has a diameter of 3 inches. In some exemplary embodiments, the hose 406 has a diameter of 4 inches. In some exemplary embodiments, the hose 406 has a diameter of 5 inches. The hose 406 can have a smooth inner surface or a non-smooth (e.g., corrugated) inner surface.

Given the need to better condition the loosefill material 420 as it is being applied (i.e., as it exits the output end 410 of the hose 406), it was discovered that, under certain conditions, the use of one or more air knives was able to provide superior results compared to various conventional approaches. For example, as shown in Tables 1-4 below, various approaches to conditioning loosefill material outside of the machine, under the same general conditions, were assessed. In some of these tests, an additional device (i.e., fluidizer type), separate from the hose itself, was used. For example, in Test #2, a spiked conduit, approximating such a device as disclosed in U.S. Pat. No. 6,648,022 (see FIG. 4 thereof), was inserted into the path of the loosefill material after it had exited the machine.

TABLE 1

| Test # | Hose Type | Fluidizer Type | Contact Thickness (inches) | Test Thickness (inches) | Meter Area Mass (grams) | Excess Mass (grams) | Box Mass (grams) |
|---|---|---|---|---|---|---|---|
| 1/Control | Non-smooth | None | 6.50 | 6.18 | 82.32 | 360 | 442.14 |
| | | | 6.82 | 6.48 | 86.45 | 372 | 458.70 |
| 2 | Non-smooth | Spiked | 6.82 | 6.48 | 82.13 | 351 | 433.40 |
| | | | 6.66 | 6.33 | 79.81 | 343 | 423.26 |
| 3 | Non-smooth | HP Air Knife | 6.80 | 6.46 | 78.3 | 343 | 421.03 |
| | | | 6.82 | 6.48 | 81.45 | 350 | 431.12 |
| 4 | Non-smooth | LP Air Knife | 6.72 | 6.38 | 83.26 | 373 | 456.07 |
| | | | 6.75 | 6.41 | 81.69 | 365 | 446.30 |
| 5 | Smooth | LP Air Knife | 6.87 | 6.53 | 83.1 | 367 | 450.31 |
| | | | 6.84 | 6.50 | 80.2 | 358 | 438.41 |
| 6 | Smooth | HP Air Knife | 6.99 | 6.64 | 79.04 | 343 | 421.87 |
| | | | 6.77 | 6.43 | 78.11 | 334 | 411.85 |
| 7 | Smooth | None | 7.00 | 6.65 | 89.51 | 386 | 475.26 |
| | | | 7.00 | 6.65 | 87.27 | 391 | 478.53 |

TABLE 2

| Test # | Hose Type | Fluidizer Type | Box Mass (lbs) | Box Density (pcf) | Box Density Average (pcf) | % Density vs. Control |
|---|---|---|---|---|---|---|
| 1/Control | Non-smooth | None | 0.97 | 0.539 | 0.536 | — |
| | | | 1.01 | 0.533 | | |
| 2 | Non-smooth | Spiked | 0.96 | 0.503 | 0.503 | −6% |
| | | | 0.93 | 0.503 | | |
| 3 | Non-smooth | HP Air Knife | 0.93 | 0.490 | 0.496 | −8% |
| | | | 0.95 | 0.501 | | |
| 4 | Non-smooth | LP Air Knife | 1.01 | 0.538 | 0.531 | −1% |
| | | | 0.98 | 0.524 | | |
| 5 | Smooth | LP Air Knife | 0.99 | 0.519 | 0.513 | −4% |
| | | | 0.97 | 0.508 | | |
| 6 | Smooth | HP Air Knife | 0.93 | 0.478 | 0.480 | −10% |
| | | | 0.91 | 0.482 | | |
| 7 | Smooth | None | 1.05 | 0.538 | 0.540 | 1% |
| | | | 1.05 | 0.542 | | |

TABLE 3

| Test # | Hose Type | Fluidizer Type | Meter Density (pcf) | k-value (BTU · in/ hr · ft$^2$ · ° F.) | Meter k-Dev (BTU · in/ hr · ft$^2$ · ° F.) | Average Meter k-Dev (BTU · in/ hr · ft$^2$ · ° F.) |
|---|---|---|---|---|---|---|
| 1/Control | Non-smooth | None | 0.508 | 0.3543 | 0.012 | 0.008 |
| | | | 0.508 | 0.3473 | 0.005 | |
| 2 | Non-smooth | Spiked | 0.483 | 0.3565 | 0.007 | 0.004 |
| | | | 0.481 | 0.3516 | 0.001 | |
| 3 | Non-smooth | HP Air Knife | 0.462 | 0.3532 | (0.004) | (0.003) |
| | | | 0.479 | 0.3484 | (0.003) | |
| 4 | Non-smooth | LP Air Knife | 0.497 | 0.3468 | 0.001 | 0.000 |
| | | | 0.485 | 0.3488 | (0.000) | |
| 5 | Smooth | LP Air Knife | 0.485 | 0.3486 | (0.001) | 0.000 |
| | | | 0.470 | 0.3548 | 0.001 | |
| 6 | Smooth | HP Air Knife | 0.453 | 0.3586 | (0.001) | (0.001) |
| | | | 0.463 | 0.3567 | 0.000 | |
| 7 | Smooth | None | 0.513 | 0.3478 | 0.007 | 0.009 |
| | | | 0.500 | 0.3563 | 0.012 | |

TABLE 4

| Test # | Hose Type | Fluidizer Type | Performance Improvement (k-Dev) vs. Control |
|---|---|---|---|
| 1/Control | Non-smooth | None | — |
| 2 | Non-smooth | Spiked | (0.005) |
| 3 | Non-smooth | HP Air Knife | (0.012) |
| 4 | Non-smooth | LP Air Knife | (0.008) |
| 5 | Smooth | LP Air Knife | (0.008) |
| 6 | Smooth | HP Air Knife | (0.009) |
| 7 | Smooth | None | 0.001 |

The testing was conducted in accordance with ASTM C 687, the entire disclosure of which is incorporated herein by reference.

Per ASTM C 687, a thermal test specimen frame with dimensions 24"×24"×6" tall is installed with loosefill insulation. The top of the insulation is leveled (Contact Thickness) per ASTM C 739. The Test Thickness is calculated from Equation 1.

$$\text{Test Thickness}=\text{Contact Thickness}\times 0.95 \tag{1}$$

After the material-filled thermal test specimen is tested via ASTM C 518 (thermal tester), the 10"×10" test area (meter) density of the insulation is calculated via Equation 2.

$$D_m = \frac{M_m}{A_m \times L} \tag{2}$$

Where:

$D_m$=test (meter) density of insulation (pet);

$M_m$=mass of material contained in the meter area frame (lbs);

$A_m$=Area of the metering area frame (ft$^2$); and

L=Test thickness (ft).

The density of the entire thermal box (box density) is calculated via Equation 3.

$$D_B = \frac{M_B}{A_B \times L} \tag{3}$$

Where:

$D_B$=box density of insulation (pcf);

$M_B$=mass of material contained in the thermal test specimen frame (lbs);

$A_B$=Area of the thermal test specimen frame (ft$^2$); and

L=Test thickness (ft).

During the fluidizing trials a control was established by running the manufacturing line at standard line operating and standard loosefill blowing machine configurations. Relative density performance of the trial (fluidizing) material vs. control is calculated by Equation 4.

$$D_l = \frac{(D_t - D_c)}{D_c} \times 100 \tag{4}$$

Where:

$D_l$=Density vs. control; note that a negative value translates to lighter density (pcf);

$D_t$=Box density of trial material (pcf); and $D_e$=Box density of control material (pcf).

Figure 7:
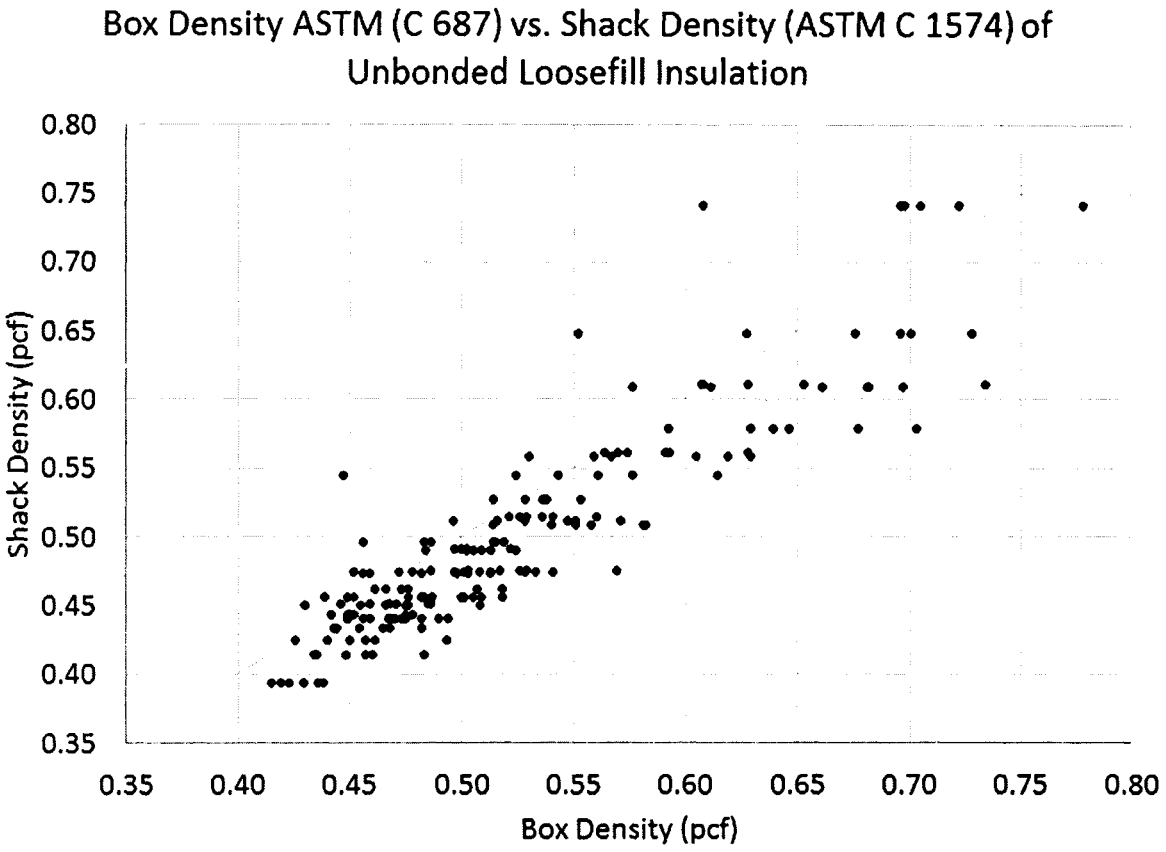
FIG. 7 is a graph comparing the box density (ASTM C 687) and shack density (ASTM C 1574) of unbonded loosefill insulation.

As shown in FIG. 7, box density is linear with the traditional "shack" test method used to determine installed density (see ASMT C 1574). The relationship between box and shack density was used to support the relative density performance findings between trial and control material.

The testing was carried out using standard attic loosefill insulation, as produced and sold by Owens Corning. The thermal performance of the loosefill insulation is characterized by Equation 5.

$$k=0.1959+0.0744/\text{meter density} \tag{5}$$

Where:

k=thermal conductivity (Btu·in/hr·ft$^2$·° F.).

The thermal performance of the trial material relative to k is referred to as "meter k-deviation" and is calculated via Equation 6.

$$k\text{-deviation}=k_t-k \tag{6}$$

Where:

k-deviation=thermal conductivity relative to k (Btu·in/hr·ft$^2$·° F.); and $k_t$=thermal conductivity of trial material (Btu·in/hr·ft$^2$·° F.).

During the fluidizing trials, a control was established by running the manufacturing line at standard line operating and standard loosefill blowing machine configurations. Relative thermal performance of the trial (fluidizing) material vs. control is calculated by Equation 7.

$$kdev_l = kdev_t - kdev_c \quad (7)$$

Where:

$kdev_l$=k-deviation of trial material vs. k-deviation of control material, note that a negative value translates to improved thermal performance (Btu·in/hr·ft$^{2}$·° F.);

$kdev_t$=k-deviation of trial material (Btu·in/hr·ft$^{2}$·° F.); and $kdev_c$=k-deviation of control material (Btu·in/hr·ft$^{2}$·° F.).

In Test #1, which is considered the control, a non-smooth hose (i.e., a corrugated hose) having projections or the like extending a predetermined depth from an outer surface of the hose into an inner cavity of the hose was used. The same type and length (i.e., 150 feet) of non-smooth hose was used for Test #2, Test #3, and Test #4. Conversely, in Test #5, Test #6, and Test #7, a smooth hose of approximately the same length (i.e., 150 feet) was used. The smooth hose had the same diameter (i.e., 4 inches) of the non-smooth hose, but lacked any internal projections instead having a uniform inner surface.

In all of the tests (i.e., Test #1, Test #2, Test #3, Test #4, Test #5, Test #6, and Test #7), the loosefill blowing machine was calibrated to have an end-of-hose pressure of approximately 1.8 psi. In those tests employing a fluidizer (i.e., Test #2, Test #3, Test #4, Test #5, and Test #6), an additional length (i.e., 5 feet) of the non-smooth hose was attached to the fluidizer to facilitate placement of the loosefill material exiting the fluidizer.

In Test #1, no fluidizer device was used. Accordingly, the conditioning of the loosefill material was limited to any conditioning performed within the loosefill blowing machine and any conditioning performed by the corrugated hose. As noted above, Test #1 is considered the control for comparison purposes.

In Test #2, a fluidizer device was used. The fluidizer device was formed from a tube having a length of 16 inches, a diameter of 4 inches, and a circumference of approximately 12 inches. Along the length of the tube, 7 rows of holes were formed. The rows were evenly spaced from one another. Each row included 6 holes distributed around the circumference of the tube and spaced approximately 2 inches from one another. The holes in each row were offset from the holes in adjacent rows. In this manner, a total of 42 holes were formed in the tube. Thereafter, a metal screw was inserted into each hole such that a portion (i.e., having a length of approximately ½ inch) of the screws extended into the inner cavity of the tube. Accordingly, the fluidizer device further conditioned the loosefill material beyond the conditioning performed by the loosefill blowing machine and the corrugated hose.

In Test #3, a fluidizer device was used. The fluidizer device included a cylindrical housing with an input port and an output port. The housing had a diameter of 6 inches and a length of 6 feet. The input port was connected to the output end of the 150-foot long non-smooth hose. The output port was connected to the input end of the 5-foot long non-smooth hose. Because the hoses had a diameter of 4 inches and the cylindrical housing had a diameter of 6 inches, appropriately shaped and sized couplers were positioned at the input port and the output port to provide a step down diameter of 4 inches, thereby facilitating the interface of the fluidizer device with the hoses. In this manner, the housing defined a space through which the loosefill material traveled prior to reaching its final destination. The housing included two apertures formed therein. Each aperture was used to interface with a high-pressure (i.e., 80 psi) air knife. Each air knife was connected to a source of compressed air. The air knives shaped the compressed air to form a pair of uniform sheets of high-velocity air. Since each air knife was positioned so that its laminar airflow would pass through the corresponding aperture in the housing and into the space therein, the air knives further conditioned the loosefill material flowing through the fluidizer device, beyond the conditioning performed by the loosefill blowing machine and the corrugated hose.

In Test #4, a fluidizer device was used. The fluidizer device included a box-like housing with an input port and an output port. The housing had dimensions of 12 inches×12 inches×48 inches. The input port was connected to the output end of the 150-foot long non-smooth hose. The output port was connected to the input end of the 5-foot long non-smooth hose. In this manner, the housing defined a space through which the loosefill material traveled prior to reaching its final destination. The housing included two apertures formed therein. Each aperture was used to interface with a low-pressure (i.e., 2.5 psi) air knife. Each air knife was connected to a source of compressed air. The air knives shaped the compressed air to form a pair of uniform sheets of high-velocity air. Since each air knife was positioned so that its laminar airflow would pass through the corresponding aperture in the housing and into the space therein, the air knives further conditioned the loosefill material flowing through the fluidizer device, beyond the conditioning performed by the loosefill blowing machine and the corrugated hose.

In Test #5, a fluidizer device was used. The fluidizer device included a box-like housing with an input port and an output port. The housing had dimensions of 12 inches×12 inches×48 inches. The input port was connected to the output end of the 150-foot long smooth hose. The output port was connected to the input end of the 5-foot long non-smooth hose. In this manner, the housing defined a space through which the loosefill material traveled prior to reaching its final destination. The housing included two apertures formed therein. Each aperture was used to interface with a low-pressure (i.e., 2.5 psi) air knife. Each air knife was connected to a source of compressed air. The air knives shaped the compressed air to form a pair of uniform sheets of high-velocity air. Since each air knife was positioned so that its laminar airflow would pass through the corresponding aperture in the housing and into the space therein, the air knives further conditioned the loosefill material flowing through the fluidizer device, beyond the conditioning performed by the loosefill blowing machine and the smooth hose.

In Test #6, a fluidizer device was used. The fluidizer device included a cylindrical housing with an input port and an output port. The housing had a diameter of 6 inches and a length of 6 feet. The input port was connected to the output end of the 150-foot long smooth hose. The output port was connected to the input end of the 5-foot long non-smooth hose. In this manner, the housing defined a space through which the loosefill material traveled prior to reaching its final destination. The housing included two apertures formed therein. Each aperture was used to interface with a high-pressure (i.e., 80 psi) air knife. Each air knife was connected to a source of compressed air. The air knives shaped the compressed air to form a pair of uniform sheets of high-velocity air. Since each air knife was positioned so that its laminar airflow would pass through the corresponding aperture in the housing and into the space therein, the air knives further conditioned the loosefill material flowing through the fluidizer device, beyond the conditioning performed by the loosefill blowing machine and the smooth hose.

In Test #7, no fluidizer device was used. Furthermore, the smooth (i.e., non-corrugated) hose was used to convey the loosefill material to its intended destination. Accordingly, the conditioning of the loosefill material was limited to any conditioning performed within the loosefill blowing machine and the smooth hose.

The results of these tests provided information which is summarized in Tables 1-4. As can be seen in these tables (particularly Tables 3-4), Test #3, Test #4, Test #5, and Test #6 establish the viability of using air knives to further condition loosefill material, beyond any conditioning that may occur in the loosefill blowing machine and/or the hose attached thereto. In particular, a Meter k-Dev value less than 1/Control (i.e., Test #1) indicates reduced thermal conductivity and, thus, a performance improvement. Consequently, the general inventive concepts allow for achieving a desired thermal performance without requiring application of additional (i.e., excess) loosefill material or otherwise mitigating against the need for such excess loosefill material.

Returning to FIGS. 4A-4E, the system 400 includes at least one air knife 450 for further conditioning the loosefill material 420 exiting the loosefill blowing machine 402 and passing through the hose 406. In the system 400, the air knife 450 is external to the loosefill blowing machine 402. However, in some exemplary embodiments, the air knife 450 could be integrated with the outlet 404 of the loosefill blowing machine 402.

In some exemplary embodiments, the air knife 450 is positioned at the input end 408 of the hose 406 (i.e., between the outlet 404 of the loosefill blowing machine 402 and the hose 406). In some exemplary embodiments, the air knife 450 is positioned at the output end 410 of the hose 406. In these latter embodiments, a supplemental hose (not shown) could be used with the air knife 450 to facilitate delivery of the loosefill material after conditioning by the air knife 450.

Figure 4A:
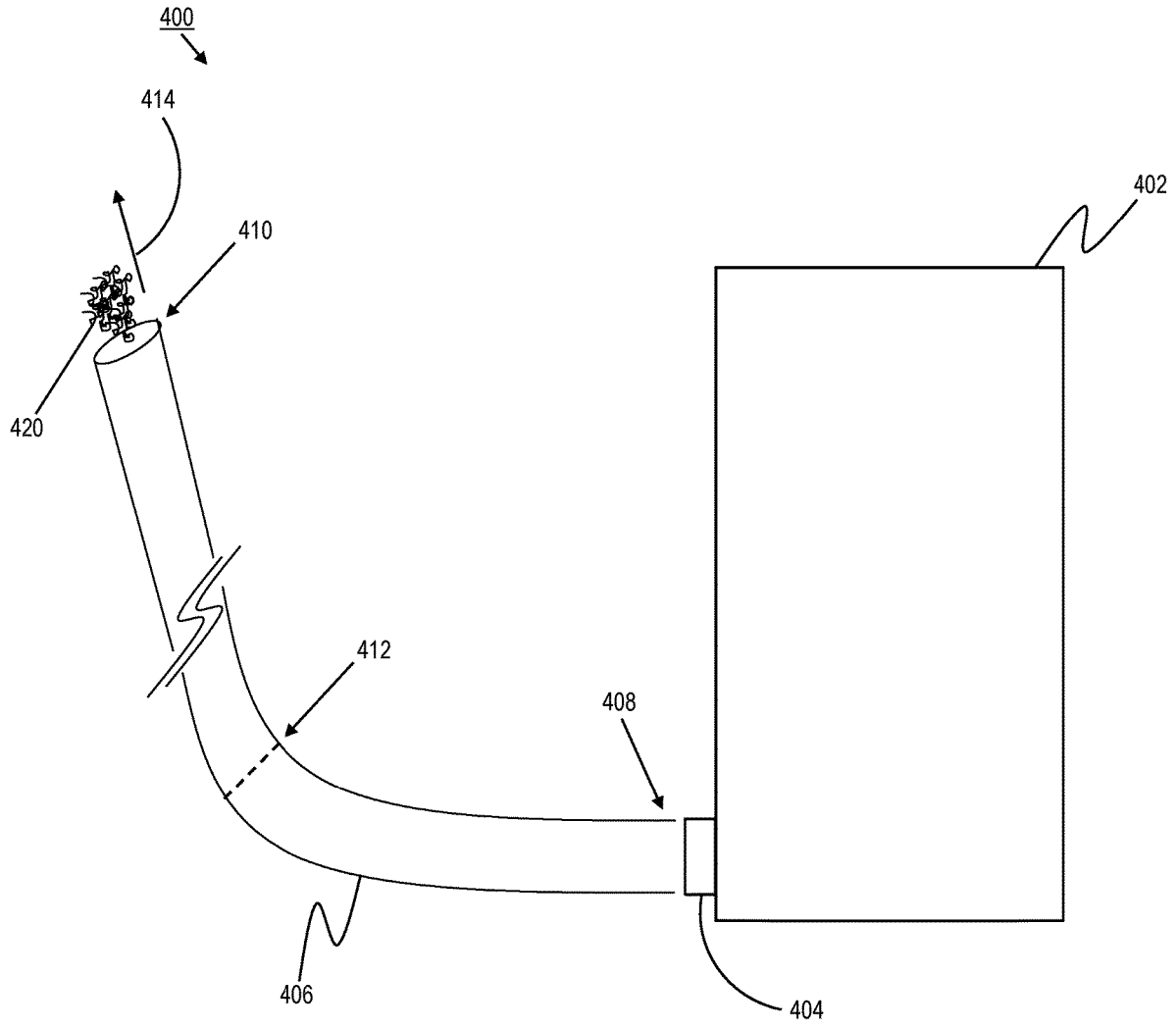
FIGS. 4A-4E are diagrams illustrating a system for further conditioning loosefill material, according to an exemplary embodiment.
Figure 4B:
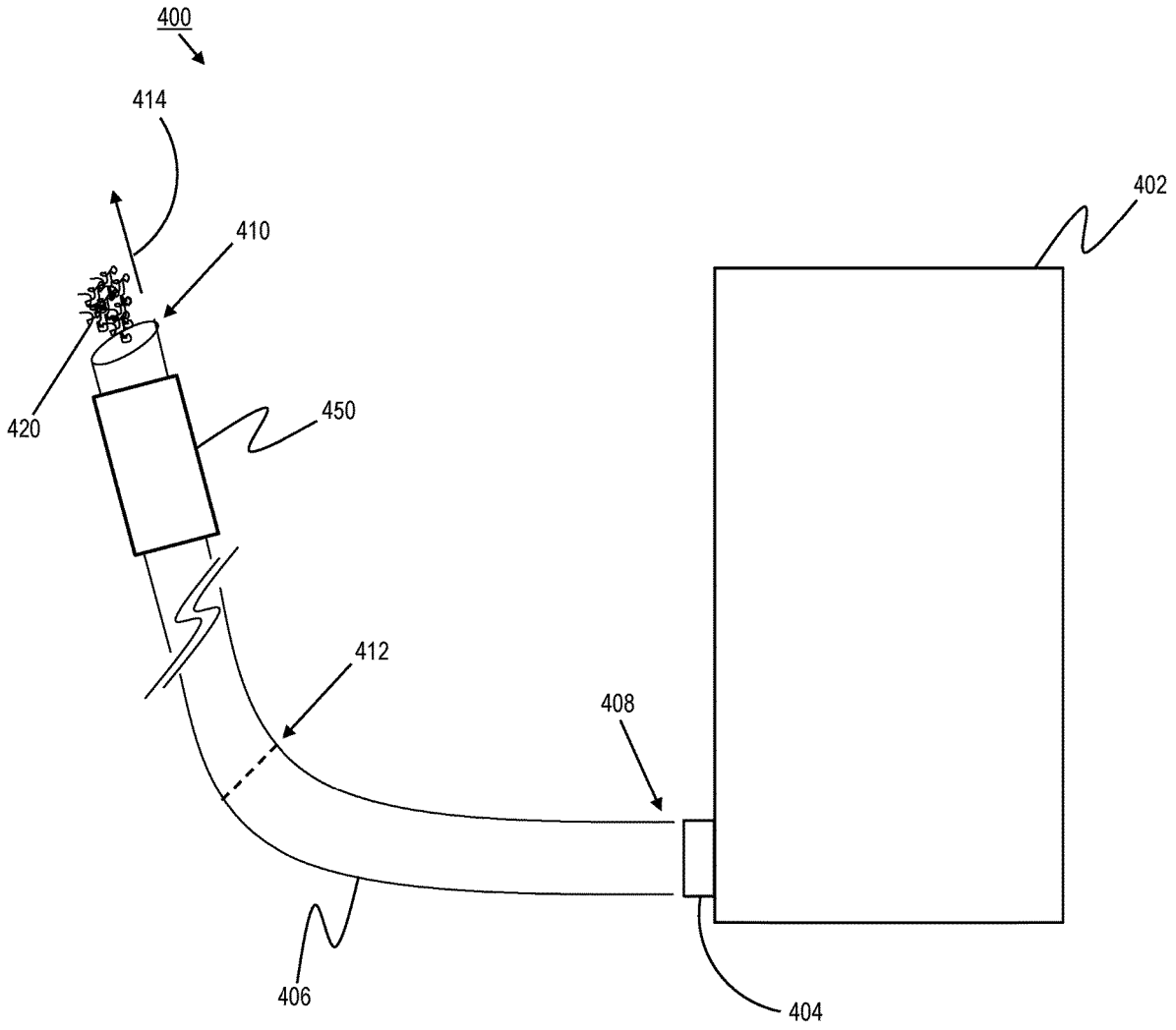

In some exemplary embodiments, the air knife 450 is positioned between the output end 410 of the hose 406 and the midline 412 of the hose 406 (see FIG. 4B). In some exemplary embodiments, the air knife 450 is positioned closer to the output end 410 of the hose 406 than the midline 412 of the hose 406. In some exemplary embodiments, the air knife 450 is positioned closer to the midline 412 of the hose 406 than the output end 410 of the hose 406.

Figure 4C:
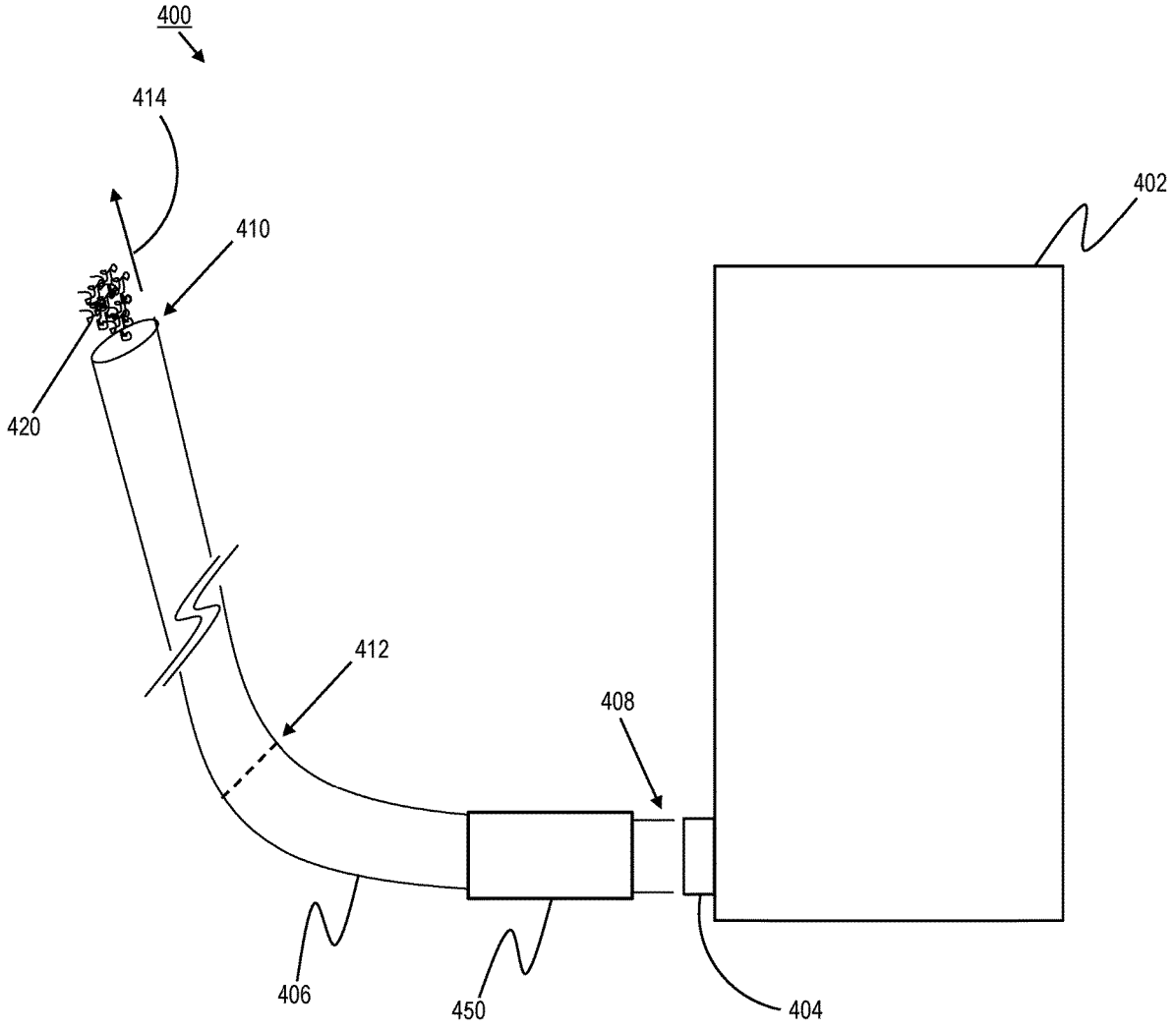

In some exemplary embodiments, the air knife 450 is positioned between the input end 408 of the hose 406 and the midline 412 of the hose 406 (see FIG. 4C). In some exemplary embodiments, the air knife 450 is positioned closer to the input end 408 of the hose 406 than the midline 412 of the hose 406. In some exemplary embodiments, the air knife 450 is positioned closer to the midline 412 of the hose 406 than the input end 408 of the hose 406.

Figure 4D:
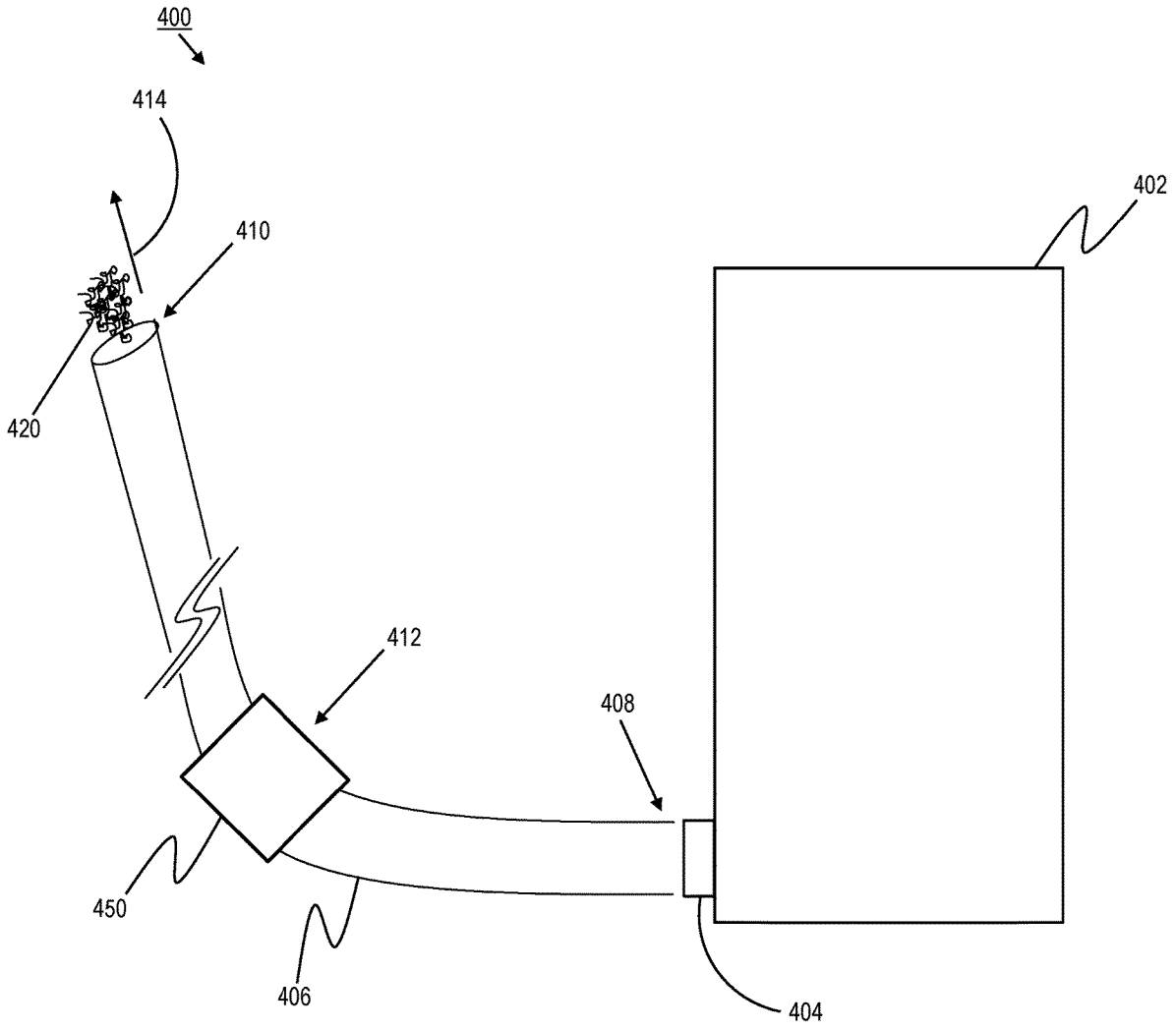

In some exemplary embodiments, the air knife 450 is positioned such that at least a portion of the air knife 450 overlaps with the midline 412 of the hose 406 (see FIG. 4D).

Figure 4E:
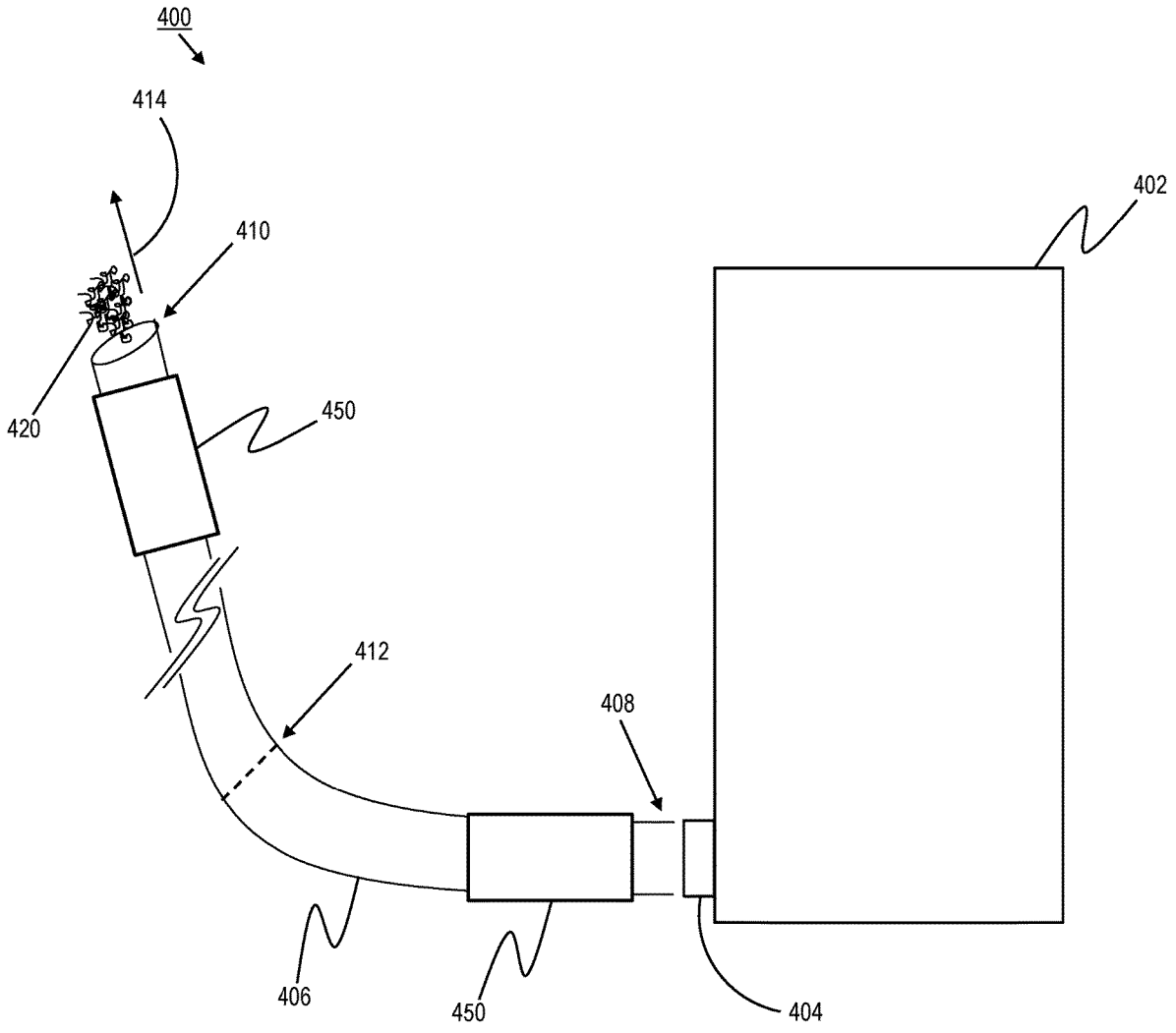

In some exemplary embodiments, multiple air knives 450 can be used with the system 400 (see FIG. 4E).

A benefit of the improved conditioning of the loosefill material is better thermal performance. For example, given the standard configuration used in Test #1 (control), the loosefill blowing machine had a blow rate of approximately 17 lbs./min. A 1,000 square-foot attic insulated to an R30 level requires approximately 416 lbs. of a given loosefill material, which takes approximately 24.5 minutes to install. By using the fluidizer device from Test #3 (i.e., including a pair of high-pressure air knives), the blow rate remains constant but the improved conditioning (e.g., lighter density) imparted by the fluidizer device results in only approximately 390 lbs. of the given loosefill material being needed, which takes less than 23 minutes to install.

Thus, another benefit from the improved conditioning of the loosefill material is faster installation times (i.e., cubic feet/minute). For example, given the standard configuration used in Test #1 (control), the loosefill blowing machine was able to deliver approximately 470 cfm of loosefill material. Use of a fluidizer device, such as those disclosed herein, including at least one air knife resulted in the loosefill blowing machine being able to deliver from 40 to 280 additional cfm of the loosefill material.

Figure 5A:
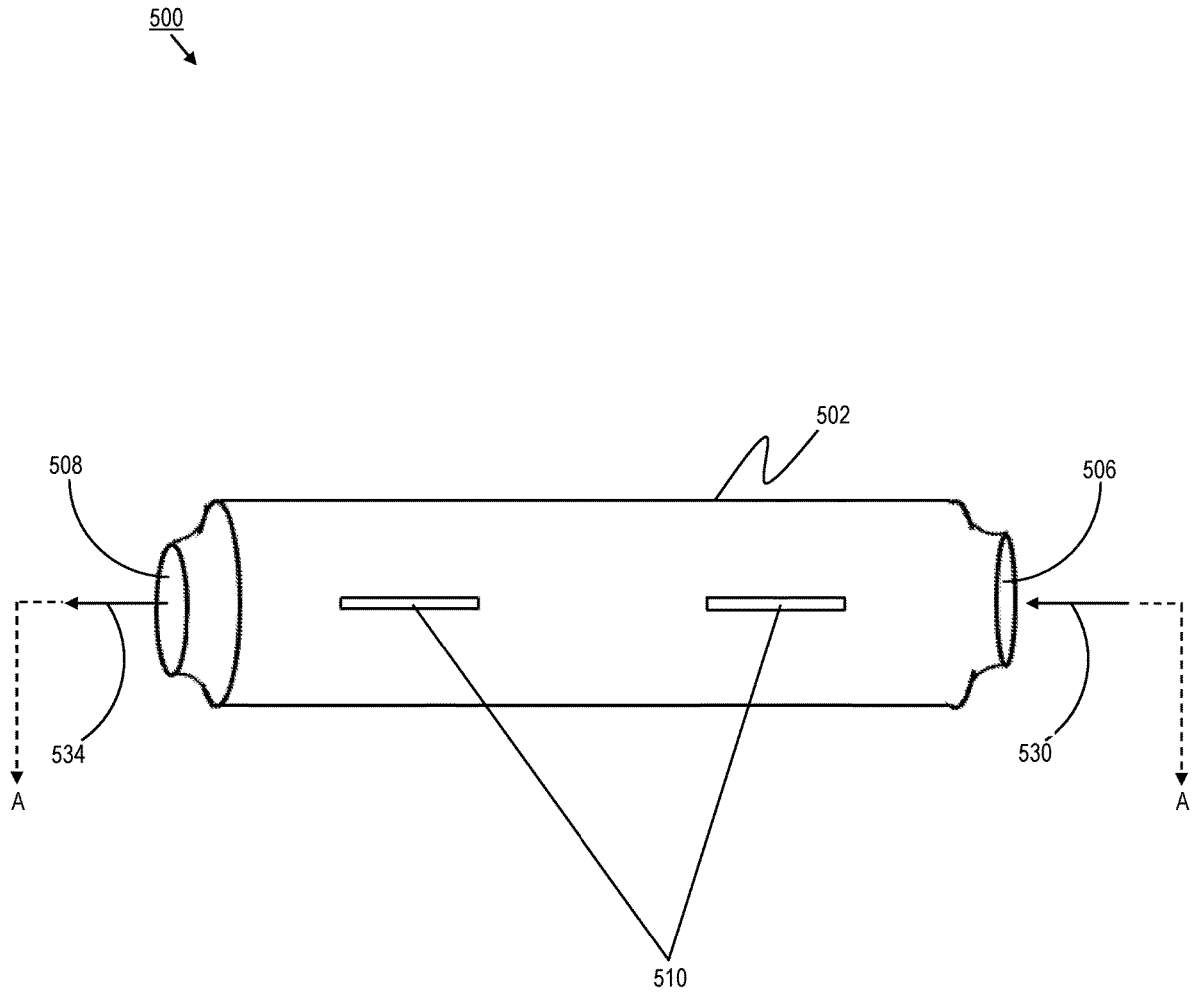
FIGS. 5A-5B are diagrams illustrating a fluidizer device, according to an exemplary embodiment.
Figure 5B:
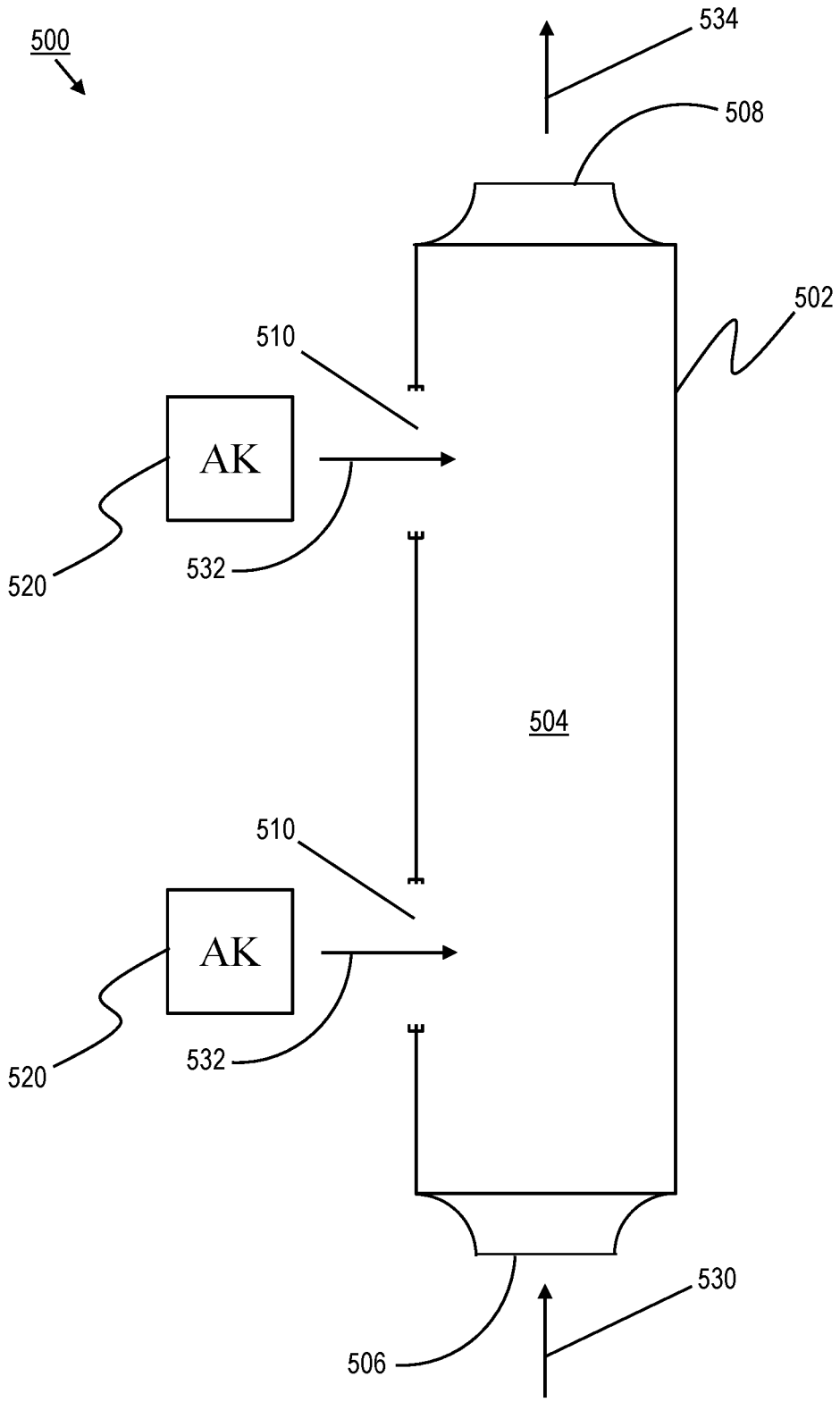

A fluidizer device 500, according to an exemplary embodiment, is shown in FIGS. 5A-5B. The fluidizer device 500 includes a cylindrical housing 502 that defines an interior cavity 504. The cylindrical housing 502 can have any suitable length. In some exemplary embodiments, the cylindrical housing 502 has a length of 6 feet. The cylindrical housing 502 can have any suitable diameter. In some exemplary embodiments, the cylindrical housing 502 has a diameter (or at least a largest inner diameter) of 6 inches.

Opposite ends of the cylindrical housing 502 are open to define an input opening 506 and an output opening 508, respectively. A pair of apertures 510 are formed in the cylindrical housing 502, each aperture 510 being sized and shaped to interface with a corresponding air knife 520 (see FIG. 5B).

In operation, loosefill material output from a loosefill blowing machine (e.g., the loosefill blowing machine 402) and possibly traveling through a hose (e.g., the hose 406) enters the cylindrical housing 502 through the input opening 506, as represented by arrow 530.

As the loosefill material passes through the interior cavity 504 of the cylindrical housing 502, it is impinged upon by the air knives 520. The air knives 520 are connected to a source of compressed air or other pressurized gas (not shown). The air knives 520 shape the compressed air, typically into laminar sheets of high-velocity air, which are then fed through the apertures 510 in the cylindrical housing 502, as represented by arrows 532.

Although the sheets of air are adjacent and parallel to one another in this exemplary embodiment, the general inventive concepts contemplate other arrangements of the air knives 520 and corresponding apertures 510, such that the sheets of air could assume other spatial positions relative to one another.

In some exemplary embodiments, the air knives 520 operate at a relatively low pressure in the range of 1 psi to 5 psi. In some exemplary embodiments, the air knives 520 operate at a pressure of 2.5 psi. In some exemplary embodiments, the air knives 520 operate at a relatively high pressure in the range of 40 psi to 120 psi. In some exemplary embodiments, the air knives 520 operate at a pressure of 80 psi.

As the amplified air from the air knives 520 interacts with the loosefill material within the interior cavity 504, the loosefill material is further conditioned before exiting the cylindrical housing 502 through the output opening 508, as represented by arrow 534.

Figure 6A:
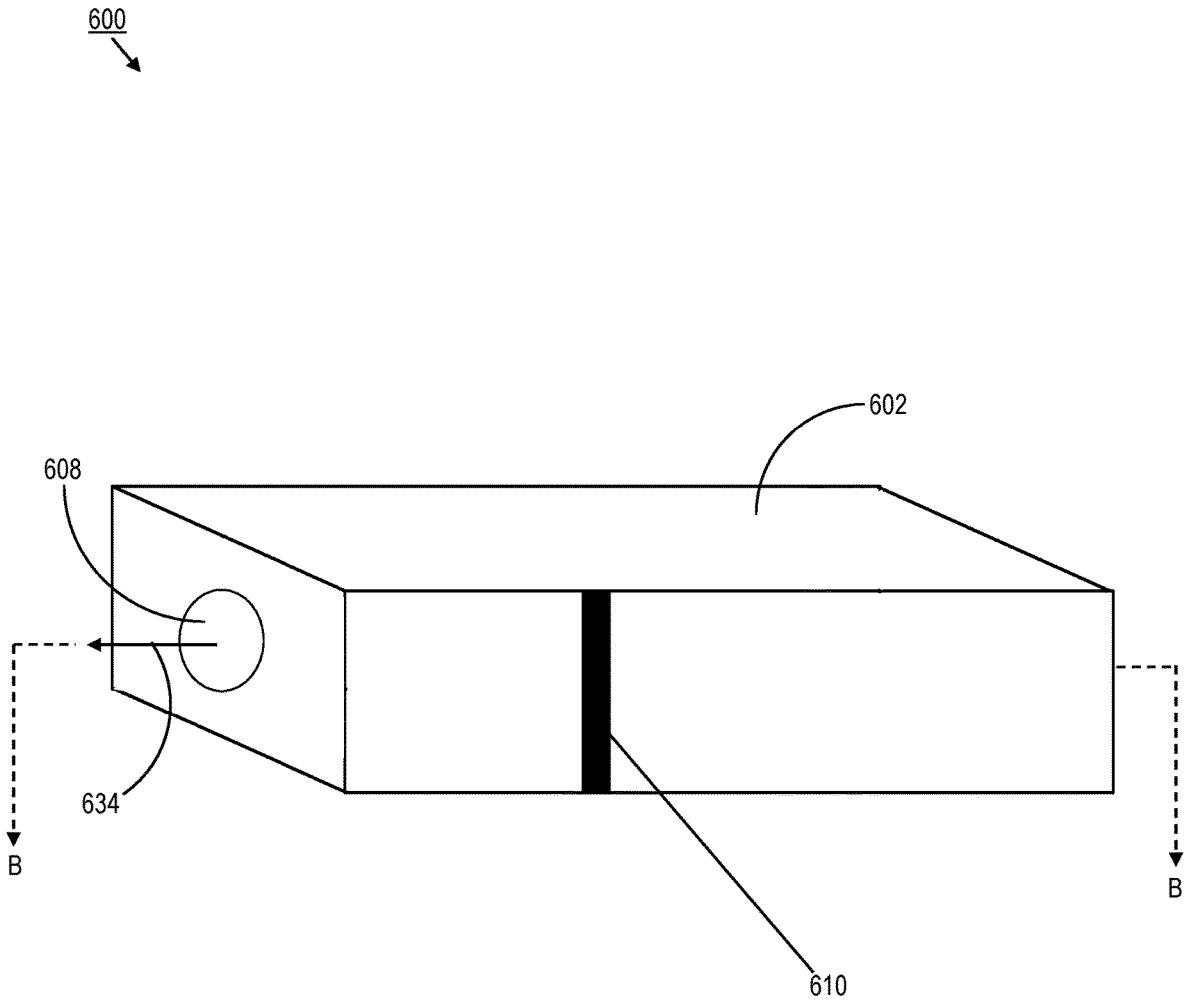
FIGS. 6A-6E are diagrams illustrating a fluidizer device, according to an exemplary embodiment.
Figure 6B:
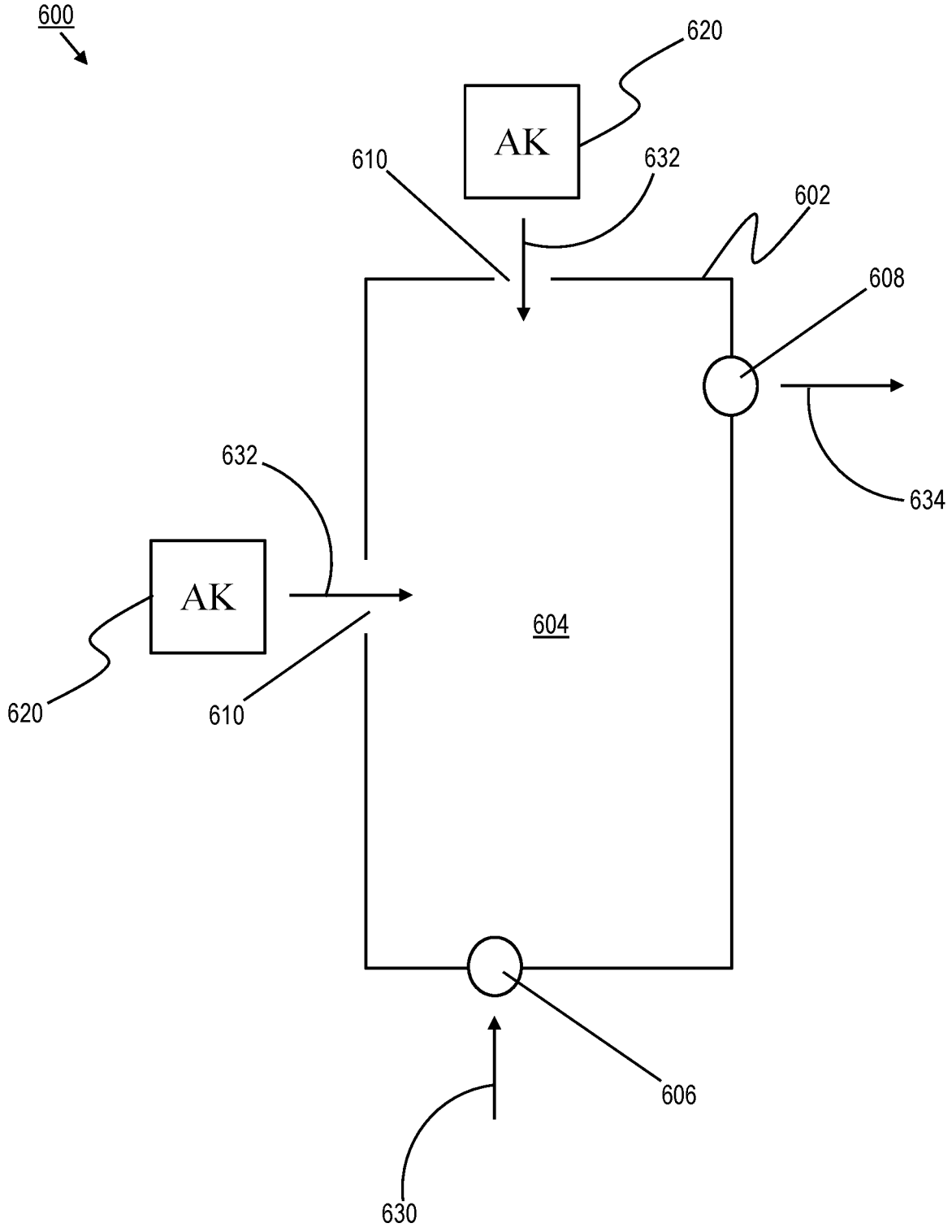

A fluidizer device 600, according to an exemplary embodiment, is shown in FIGS. 6A-6B. The fluidizer device 600 includes a box-like housing 602 that defines an interior cavity 604. The box-like housing 602 can have any suitable dimensions. In some exemplary embodiments, the box-like housing 602 has a width of 12 inches, a length of 48 inches, and a height of 12 inches.

The box-like housing 602 includes a pair of openings that define an input opening 606 and an output opening 608, respectively. A pair of apertures 610 are formed in the box-like housing 602, each aperture 610 being sized and shaped to interface with a corresponding air knife 620 (see FIG. 6B).

In operation, loosefill material output from a loosefill blowing machine (e.g., the loosefill blowing machine 402) and possibly traveling through a hose (e.g., the hose 406) enters the box-like housing 602 through the input opening 606, as represented by arrow 630.

As the loosefill material passes through the interior cavity 604 of the box-like housing 602, it is impinged upon by the air knives 620. The air knives 620 are connected to a source of compressed air or other pressurized gas (not shown). The air knives 620 shape the compressed air, typically into laminar sheets of high-velocity air, which are then fed through the apertures 610 in the box-like housing 602, as represented by arrows 632.

Figure 6C:
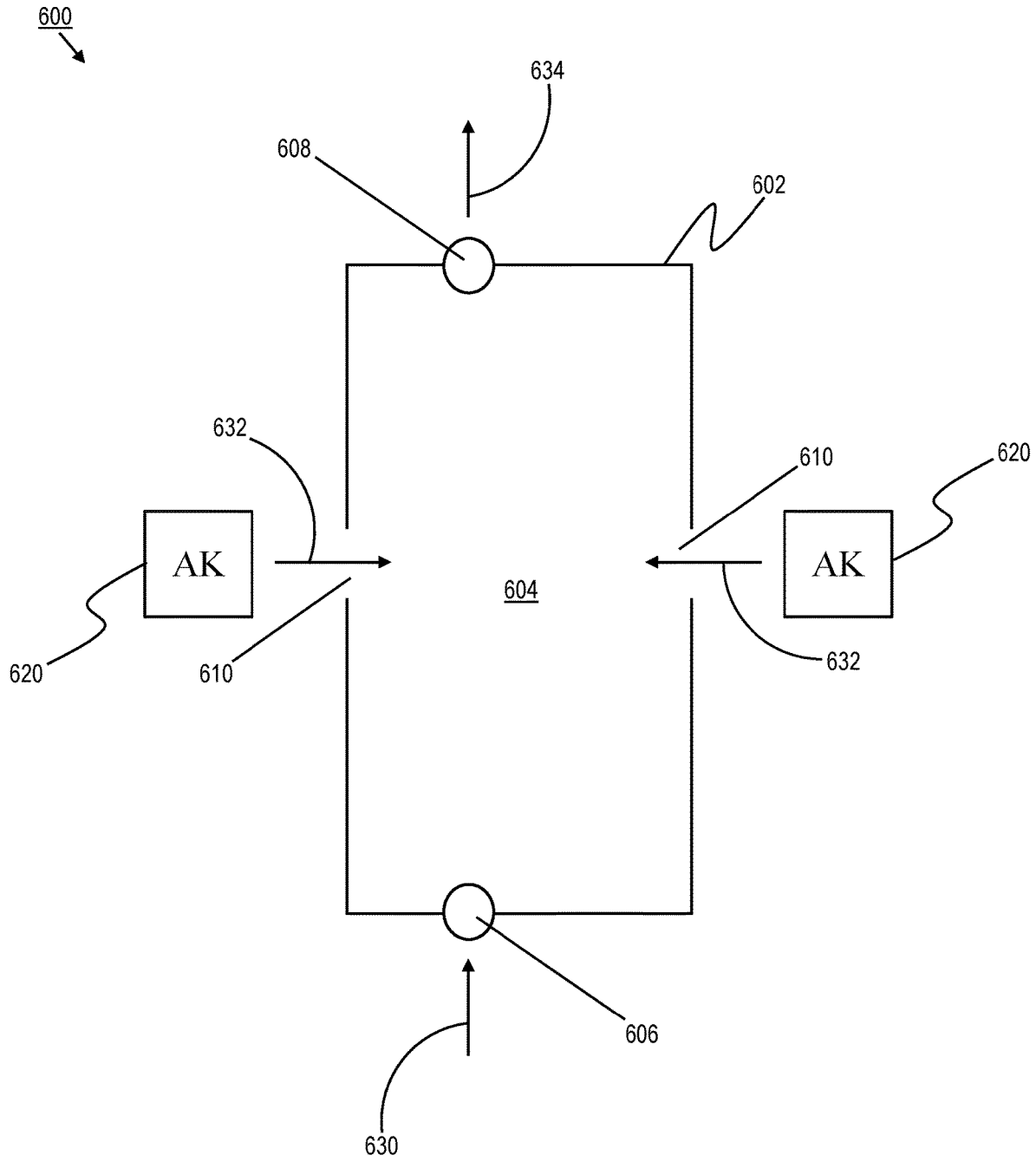
Figure 6D:
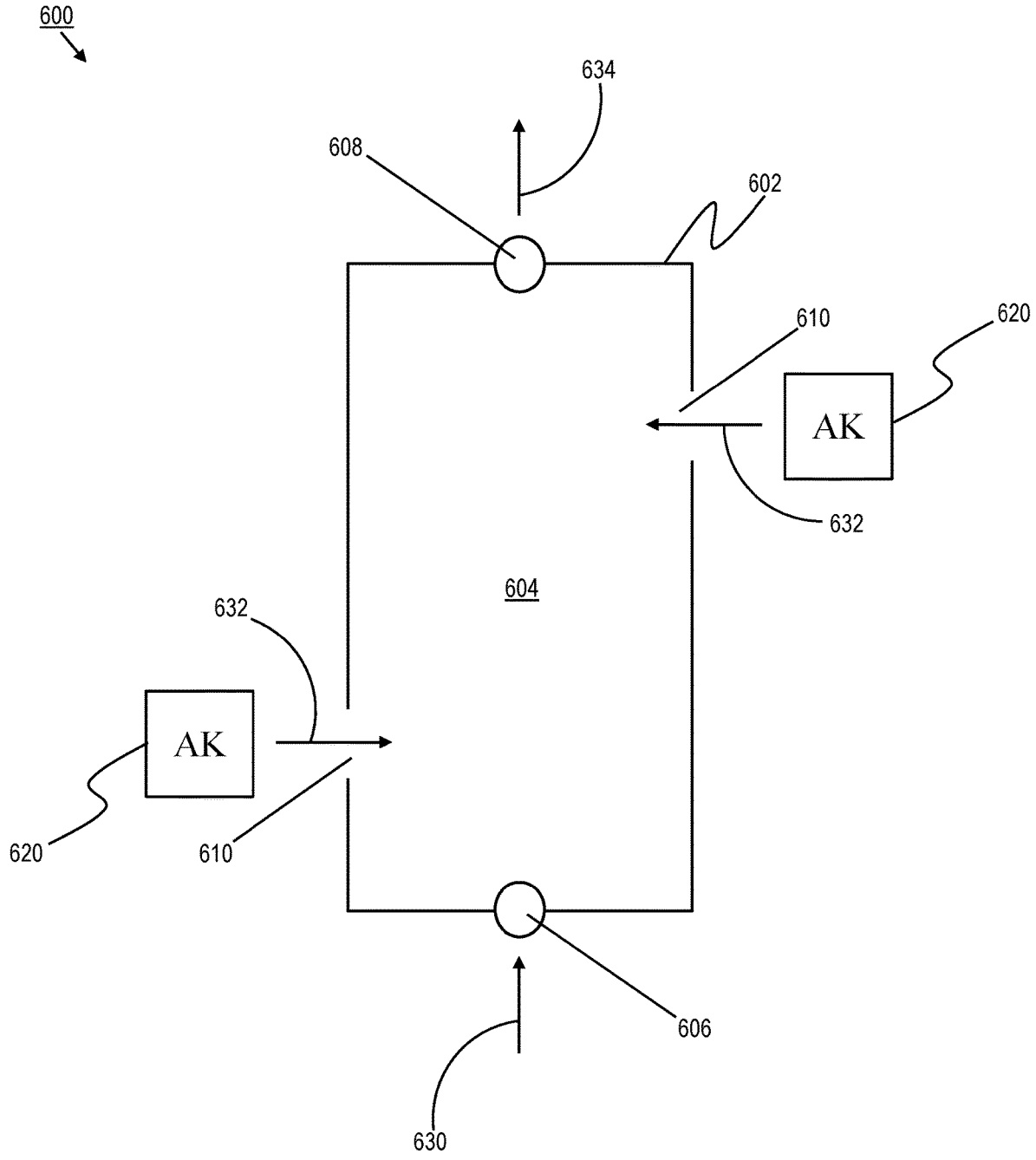
Figure 6E:
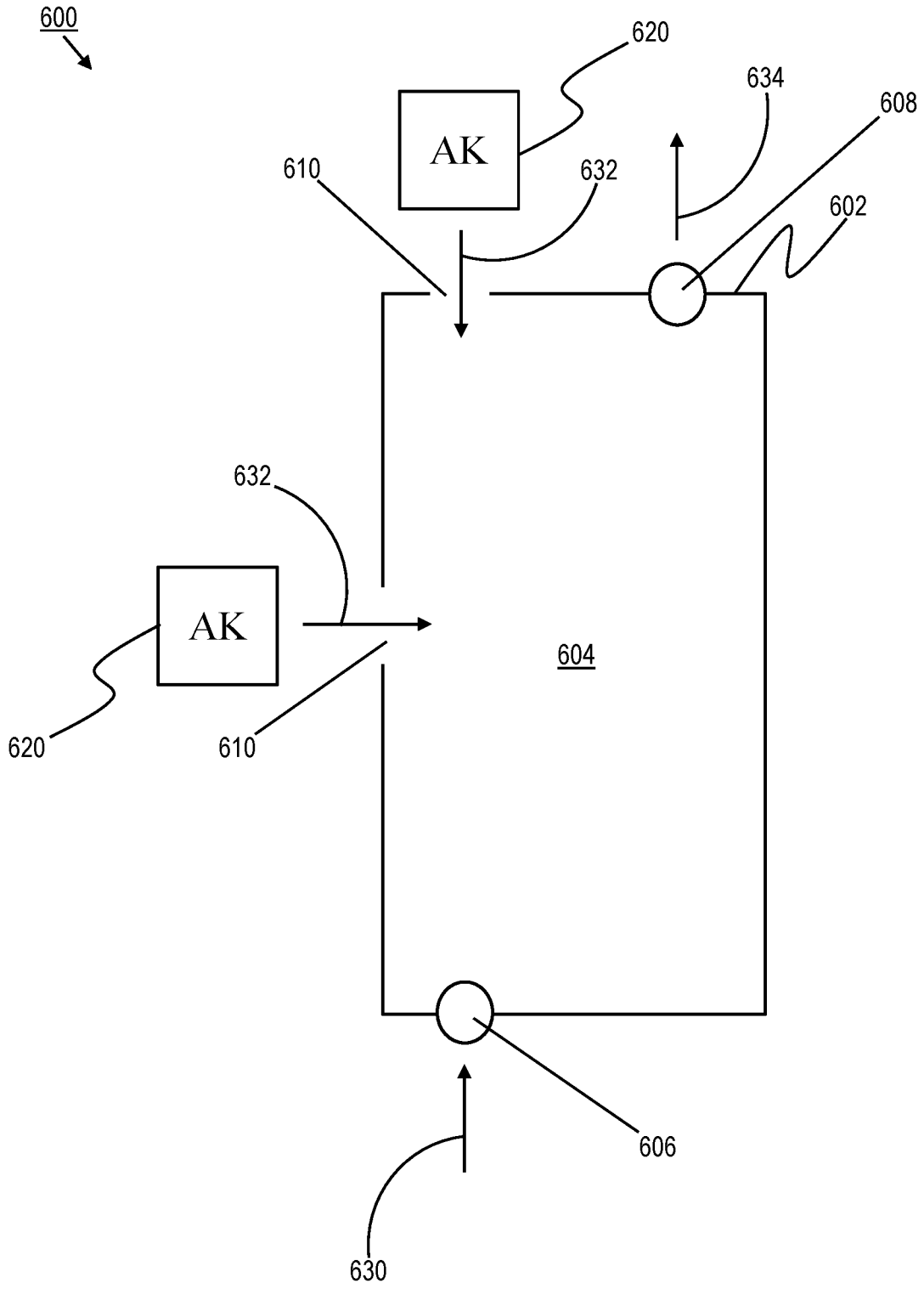

Although the sheets of air are adjacent and perpendicular to one another in this exemplary embodiment, the general inventive concepts contemplate other arrangements of the air knives 620 and corresponding apertures 610, such that the sheets of air could assume other spatial positions relative to one another. A few such exemplary alternative arrangements are shown in FIGS. 6C-6E.

In some exemplary embodiments, the air knives 620 operate at a relatively low pressure in the range of 1 psi to 5 psi. In some exemplary embodiments, the air knives 620 operate at a pressure of 2.5 psi. In some exemplary embodiments, the air knives 620 operate at a relatively high pressure in the range of 40 psi to 120 psi. In some exemplary embodiments, the air knives 620 operate at a pressure of 80 psi.

As the amplified air from the air knives 620 interacts with the loosefill material within the interior cavity 604, the loosefill material is further conditioned before exiting the box-like housing 602 through the output opening 608, as represented by arrow 634.

The above description of specific embodiments has been given by way of example. From the disclosure given, those skilled in the art will not only understand the general inventive concepts and their attendant advantages, but will also find apparent various changes and modifications to the structures and concepts disclosed. For example, although the disclosed embodiments are shown and described as using a pair of air knives, the general inventive concepts contemplate that more or fewer air knives could be used in different embodiments. It is sought, therefore, to cover all such changes and modifications as fall within the spirit and scope of the general inventive concepts, as defined herein, and by any currently presented or future presented claims, and equivalents thereof.

What is claimed is:

1. A system for conditioning loosefill material during application thereof, the system comprising:

a machine for distributing loosefill material, the machine comprising:

a chute configured to receive and direct the loosefill material in a machine direction;

a shredder configured to shred and pick apart the loosefill material; and a blower for distributing the loosefill material into an airstream;

a hose connected to the machine for conveying the loosefill material in the airstream; and a fluidizer for receiving the loosefill material in the airstream and conditioning the loosefill material to decrease its average density, wherein the fluidizer includes a first air knife that generates a first shaped stream of air that impinges on the loosefill material within the fluidizer;

wherein the fluidizer includes a second air knife that generates a second shaped stream of air that impinges on the loosefill material within the fluidizer; and wherein the first shaped stream of air and the second shaped stream of air flow parallel to one another within the fluidizer.

2. The system of claim 1, wherein the fluidizer is positioned between the machine and the hose.

3. The system of claim 1, wherein the hose includes an input end and an output end;

wherein the loosefill material enters the hose at the input end;

wherein the loosefill material exits the hose at the output end; and wherein the fluidizer is positioned at the output end of the hose.

4. The system of claim 1, wherein the hose includes an input end and an output end;

wherein the loosefill material enters the hose at the input end;

wherein the loosefill material exits the hose at the output end;

wherein the fluidizer comprises a first fluidizer and a second fluidizer;

wherein the first fluidizer is positioned at the input end of the hose; and wherein the second fluidizer is positioned at the output end of the hose.

5. The system of claim 1, wherein the hose includes an input end and an output end;

wherein the loosefill material enters the hose at the input end;

wherein the loosefill material exits the hose at the output end; and wherein the fluidizer is positioned closer to the output end of the hose than the input end of the hose.

6. The system of claim 1, wherein the hose includes an input end and an output end;

wherein the loosefill material enters the hose at the input end;

wherein the loosefill material exits the hose at the output end; and wherein the fluidizer is positioned closer to the input end of the hose than the output end of the hose.

7. The system of claim 1, wherein the hose includes an input end and an output end;

wherein the loosefill material enters the hose at the input end;

wherein the loosefill material exits the hose at the output end; and wherein the fluidizer is positioned so as to at least partially overlap with a portion of the hose equidistant from the input end of the hose and the output end of the hose.

8. The system of claim 1, wherein the hose includes a plurality of discrete segments; and wherein the fluidizer is positioned between two adjacent segments.

9. The system of claim 1, wherein an inner surface of the hose is smooth.

10. The system of claim 1, wherein an inner surface of the hose is corrugated.

11. The system of claim 1, wherein at least one of the first air knife and the second air knife operates at a pressure within the range of 1 psi to 5 psi.

12. The system of claim 1, wherein at least one of the first air knife and the second air knife operates at a pressure within the range of 40 psi to 120 psi.

13. The system of claim 1, wherein the fluidizer includes three or more air knives.

14. A system for conditioning loosefill material during application thereof, the system comprising:

a machine for distributing loosefill material, the machine comprising:

a chute configured to receive and direct the loosefill material in a machine direction;

a shredder configured to shred and pick apart the loosefill material; and a blower for distributing the loosefill material into an airstream;

a hose connected to the machine for conveying the loosefill material in the airstream; and a fluidizer for receiving the loosefill material in the airstream and conditioning the loosefill material to decrease its average density, wherein the fluidizer includes a first air knife that generates a first shaped stream of air that impinges on the loosefill material within the fluidizer;

wherein the fluidizer includes a second air knife that generates a second shaped stream of air that impinges on the loosefill material within the fluidizer; and wherein the first shaped stream of air and the second shaped stream of air intersect with one another within the fluidizer.

15. The system of claim 14, wherein the fluidizer is positioned between the machine and the hose.

16. The system of claim 14, wherein the hose includes an input end and an output end;

wherein the loosefill material enters the hose at the input end;

wherein the loosefill material exits the hose at the output end; and wherein the fluidizer is positioned at the output end of the hose.

17. The system of claim 14, wherein the hose includes an input end and an output end;

wherein the loosefill material enters the hose at the input end;

wherein the loosefill material exits the hose at the output end;

wherein the fluidizer comprises a first fluidizer and a second fluidizer;

wherein the first fluidizer is positioned at the input end of the hose; and wherein the second fluidizer is positioned at the output end of the hose.

18. The system of claim 14, wherein the hose includes an input end and an output end;

wherein the loosefill material enters the hose at the input end;

wherein the loosefill material exits the hose at the output end; and wherein the fluidizer is positioned closer to the output end of the hose than the input end of the hose.

19. The system of claim 14, wherein the hose includes an input end and an output end;

wherein the loosefill material enters the hose at the input end;

wherein the loosefill material exits the hose at the output end; and wherein the fluidizer is positioned closer to the input end of the hose than the output end of the hose.

20. The system of claim 14, wherein the hose includes an input end and an output end;

wherein the loosefill material enters the hose at the input end;

wherein the loosefill material exits the hose at the output end; and wherein the fluidizer is positioned so as to at least partially overlap with a portion of the hose equidistant from the input end of the hose and the output end of the hose.

21. The system of claim 14, wherein the hose includes a plurality of discrete segments; and wherein the fluidizer is positioned between two adjacent segments.

22. The system of claim 14, wherein an inner surface of the hose is smooth.

23. The system of claim 14, wherein an inner surface of the hose is corrugated.

24. The system of claim 14, wherein at least one of the first air knife and the second air knife operates at a pressure within the range of 1 psi to 5 psi.

25. The system of claim 14, wherein at least one of the first air knife and the second air knife operates at a pressure within the range of 40 psi to 120 psi.

26. The system of claim 14, wherein the fluidizer includes three or more air knives.

* * * * *